US007352875B2

(12) United States Patent
Hatano et al.

(10) Patent No.: US 7,352,875 B2
(45) Date of Patent: Apr. 1, 2008

(54) SPEAKER APPARATUS

(75) Inventors: Hajime Hatano, 11-16, Matsugaoka 5-chome, Kugenuma, Fujisawa-shi, Kanagawa 251-0038 (JP); Yoshihito Tamanoi, Tokyo (JP); Shinsuke Terashima, Tokyo (JP)

(73) Assignees: Hajime Hatano, Fujisawa (JP); Yamatake Corporation, Tokyo (JP)

( * ) Notice: Subject to any disclaimer, the term of this patent is extended or adjusted under 35 U.S.C. 154(b) by 332 days.

(21) Appl. No.: 10/976,316

(22) Filed: Oct. 29, 2004

(65) Prior Publication Data

US 2005/0163335 A1 Jul. 28, 2005

(30) Foreign Application Priority Data

Nov. 12, 2003 (JP) ..... 2003-383074
Aug. 31, 2004 (JP) ..... 2004-253289

(51) Int. Cl.
*H04R 25/00* (2006.01)
*H04R 1/02* (2006.01)

(52) U.S. Cl. ..... 381/160; 381/340

(58) Field of Classification Search ..... 381/341, 381/368, 430, 160, 336, 340, 162, 165; 181/175, 181/177, 192, 195
See application file for complete search history.

(56) References Cited

U.S. PATENT DOCUMENTS 3,895,188 A * 7/1975 Ingraham ..... 381/160
4,836,328 A * 6/1989 Ferralli ..... 181/155
4,865,153 A * 9/1989 Toyoda ..... 181/153
5,109,423 A * 4/1992 Jacobson et al. ..... 381/336
6,028,947 A * 2/2000 Faraone et al. ..... 381/340
6,205,228 B1 * 3/2001 Czerwinski et al. ..... 381/340
6,343,134 B1 * 1/2002 Czerwinski ..... 381/342
6,498,854 B1 * 12/2002 Smith ..... 381/67
6,574,344 B1 * 6/2003 Wiener et al. ..... 381/343
7,039,211 B2 * 5/2006 Werner ..... 381/343
2002/0070073 A1 * 6/2002 Matsumoto et al. ..... 181/182
2003/0021435 A1 * 1/2003 Nakaso ..... 381/396

* cited by examiner

*Primary Examiner*—Brian Ensey

(57) ABSTRACT

The present invention provides a speaker apparatus which has a simple structure and a high directivity and which can emit sound. The speaker apparatus includes a hood having an opening at a front end with a sound reflecting inner wall shaped like a rotating surface and provided at least on the opening side, the sound reflecting inner wall having a focus behind the opening, the hood being formed with an internal space, and a sound processing section having a vibrating surface and a sound emitting circuit both provided in the hood, the sound emitting circuit vibrating the vibrating surface. Consequently, the diameter of the vibrating surface of the sound processing section, which diameter determines the spread, outside the hood, of a sound emitted by the speaker apparatus, can be considered to be larger than its actual dimension.

13 Claims, 26 Drawing Sheets

SPEAKER APPARATUS

BACKGROUND OF THE INVENTION

1. Field of the Invention

The present invention relates to a speaker apparatus that emits sound to a limited spatial area.

2. Description of the Related Art

In recent years, speakers utilizing, for example, a parametric array effect have been known to be able to emit sound to a limited spatial area, that is, to have what is called a narrow directivity (see Non-Patent Document 1). The parametric array effect occurs as follows. For example, when an ultrasonic vibrator is used to emit an ultrasonic wave having its amplitude modulated by an audible area signal, the nonlinear sound propagation characteristic of sound wave in the air causes a modulation signal to be self-demodulated along an ultrasonic sound propagation path. Demodulated areas are distributed in an array in a direction in which the ultrasonic wave progresses. Accordingly, a demodulation wave has a high directivity in the progressing direction of the sound wave.

However, a problem with the use of the parametric array effect is the adverse effect of the powerful ultrasonic wave used on human bodies and the like.

FIG. 1 is a schematic sectional view of a speaker conventionally commonly used.

A common speaker 100 shown in FIG. 1 is mainly composed of a sound processing section 110 having an electroacoustic transducer 111 with a diaphragm 111*a* that vibrates on the basis of a signal and a case 112 that contains, for example, the electroacoustic transducer 111 and an amplifier (not shown) that amplifies the amplitude of a signal input.

The directivity of a sound emitted by a diaphragm of an electroacoustic transducer such as the one shown in FIG. 1 is generally determined by the wavelength $\lambda$ of sound emitted by the diaphragm and the diameter of the diaphragm (the diameter of the diaphragm will be referred to as D). What is called an effective directional angle $\Phi$ (degree) at which a sound pressure of $1/\sqrt{2}$ of its maximum value is approximately given by the following Expression 1:

$$\Phi \leqq 29 \times \lambda / D \qquad \text{(Expression 1)}$$

Accordingly, to improve the directivity of a sound emitted by the common speaker 100, shown in FIG. 1, it is necessary to increase relatively the diameter D of the diaphragm 111*a* of the sound processing section 110 relative to the wavelength $\lambda$ of the sound emitted as shown in the above expression.

[Non-Patent Document 1] The Acoustical Society of Japan, "Dictionary of Acoustic Terms", CORONA PUBLISHING CO., LTD., issued on Apr. 20, 1988, Page 479

However, actually, as the diameter of the diaphragm increases, more complicated facilities are disadvantageously required to precisely vibrate the diaphragm.

SUMMARY OF THE INVENTION

In view of the above circumstances, the present invention provides a speaker apparatus which has a simple structure and which has a high directivity in sound emission.

A speaker apparatus according to the present invention having:

a hood having an opening at a front end with a sound reflecting inner wall shaped like a rotating surface and provided at least on the opening side, the sound reflecting inner wall having a focus behind the opening, the hood being formed with an internal space; and a sound processing section having a vibrating surface and a sound emitting circuit that vibrates the vibrating surface, and in that at least the vibrating surface of the sound processing section is placed so as to face a front surface of the hood.

According to the speaker apparatus of the present invention, the vibrating surface of the sound processing section is provided in the hood having the opening at the front end and with the sound reflecting inner wall shaped like a rotating surface and provided at least close to the opening, the sound reflecting inner wall having the focus behind the opening, the hood being formed with the internal space. Consequently, the diameter of the vibrating surface of the sound processing section, which diameter determines the spread, outside the hood, of a sound emitted by the speaker apparatus, can be considered to be larger than its actual dimension. That is, the speaker apparatus of the present invention uses the hood of the simple structure to produce the effect that cannot be produced by the conventional speaker without using a large vibrating surface and a control device that controls operations of the vibrating surface.

The speaker apparatus of the present invention preferably has a sound absorbing material placed in the hood so as to surround a periphery of the vibrating surface.

This arrangement makes it possible to absorb a reflected sound having undergone multiple reflection in the hood, which sound affects adversely the narrowing of the spread, outside the hood, of the sound emitted from the hood. It is thus possible to reduce the spread, outside the hood, of the sound emitted from the hood and to provide a flatter frequency characteristic.

In another preferred aspect, the sound absorbing material placed in the hood is placed so as to extend around the periphery of the vibrating surface and backward from the vibrating surface or around the periphery of the vibrating surface and to a position in front of the vibrating surface.

This serves to effectively reduce the adverse effect of the multiple reflection in the hood.

Moreover, the speaker apparatus of the present invention preferably has a sound absorbing material placed along the periphery of the opening in the hood in addition to or without the sound absorbing material placed in the hood.

This arrangement enables the attenuation of a sound from the interior of the hood which is diffracted at an edge of the opening in the hood and which then leaks to a side of or behind the hood, the sound affecting adversely the narrowing the spread, outside the hood, of the sound emitted.

Further, in another preferred aspect of the speaker apparatus of the present invention, the sound absorbing material placed in the hood has concaves and convexes formed on at least one of a front surface of the sound absorbing material and a surface of the sound absorbing material which contacts with an inner wall of the hood, the concaves and convexes irregularly reflecting the sound.

This arrangement enables the attenuation of a sound incident on a surface of the sound absorbing material and a sound that travels toward the opening in the hood after being reflected by a surface of the inner wall of the hood though the sound has been absorbed by the sound absorbing material, the sound affecting adversely the narrowing the spread, outside the hood, of the sound emitted.

The vibrating surface of the sound processing section of the speaker apparatus of the present invention is preferably a spherical surface that projects frontward.

This arrangement matches the focus of the hood with the center of curvature of the spherical surface to improve the directivity.

Moreover, the speaker apparatus of the present invention has, in addition to the sound absorbing material placed in the hood, a partition wall placed in front of the vibrating surface to isolate at least a rear area of the internal space from the outside of the hood, the area including the vibrating surface.

This arrangement serves to prevent the sound processing section including the vibrating surface from being contaminated even if for example, the speaker apparatus is used outdoors. Further, the sound absorbing material provided in the hood can suppress the adverse effect on the narrowing of the spread of the emitted sound outside the hood and the degradation of the frequency characteristic, the adverse effect and degradation resulting from the multiple reflection of sound between the surface of the inner wall of the hood and the partition wall if the apparatus is provided only with the partition wall and not with the sound absorbing material in the hood.

The speaker apparatus of the present invention may have a sound emission profile adjusting mechanism that adjusts the spread, outside the hood, of a sound emitted from the vibrating surface, by adjusting the longitudinal position of the sound processing section in the hood.

This arrangement makes it possible to adjust the spread of particularly a sound of a high frequency outside the hood.

The sound processing section of the speaker of the present invention has not only the sound emitting circuit but also a sound receiving circuit that detects vibration of the vibrating surface caused by an externally incident sound. Alternatively, sound processing section of the speaker of the present invention may be a microphone having a sound receiving surface near the vibrating surface.

This arrangement allows the speaker apparatus of the present invention to be used as a sound receiving apparatus that catches only sounds within a limited range which enter the hood.

Further, the hood of the speaker of the present invention contains a light beam emitting section that emits a light beam parallel to a rotation axis of the sound reflecting inner wall shaped like a rotating surface.

This arrangement conveniently is useful for sound emission.

A front illuminating light source may be provided in the hood of the speaker of the present invention.

This arrangement allows the inner wall of the hood to be also utilized as a light reflecting wall to efficiently illuminate an object.

The speaker apparatus of the present invention enables the emission of a sound having a high directivity and an excellent frequency characteristic using the simple structure.

BRIEF DESCRIPTION OF THE DRAWINGS

FIG. 4(*b*) is a graph showing the spread, outside the hood, of a sound emitted from the hood, that is, what is called the directional characteristic;

FIG. 6(*b*) is a graph showing the directional characteristic of sound;

FIG. 14(*b*) is a diagram showing a sound pressure waveform obtained in front of the hood if a predetermined tone burst signal is applied to the speaker of the fifth embodiment;

FIG. 14(*c*) is a diagram showing a sound pressure waveform obtained in front of the hood if a predetermined tone burst signal is applied to the speaker of the fifth embodiment;

DETAILED DESCRIPTION OF THE INVENTION

Embodiments of the present invention will be described below.

Figure 2:
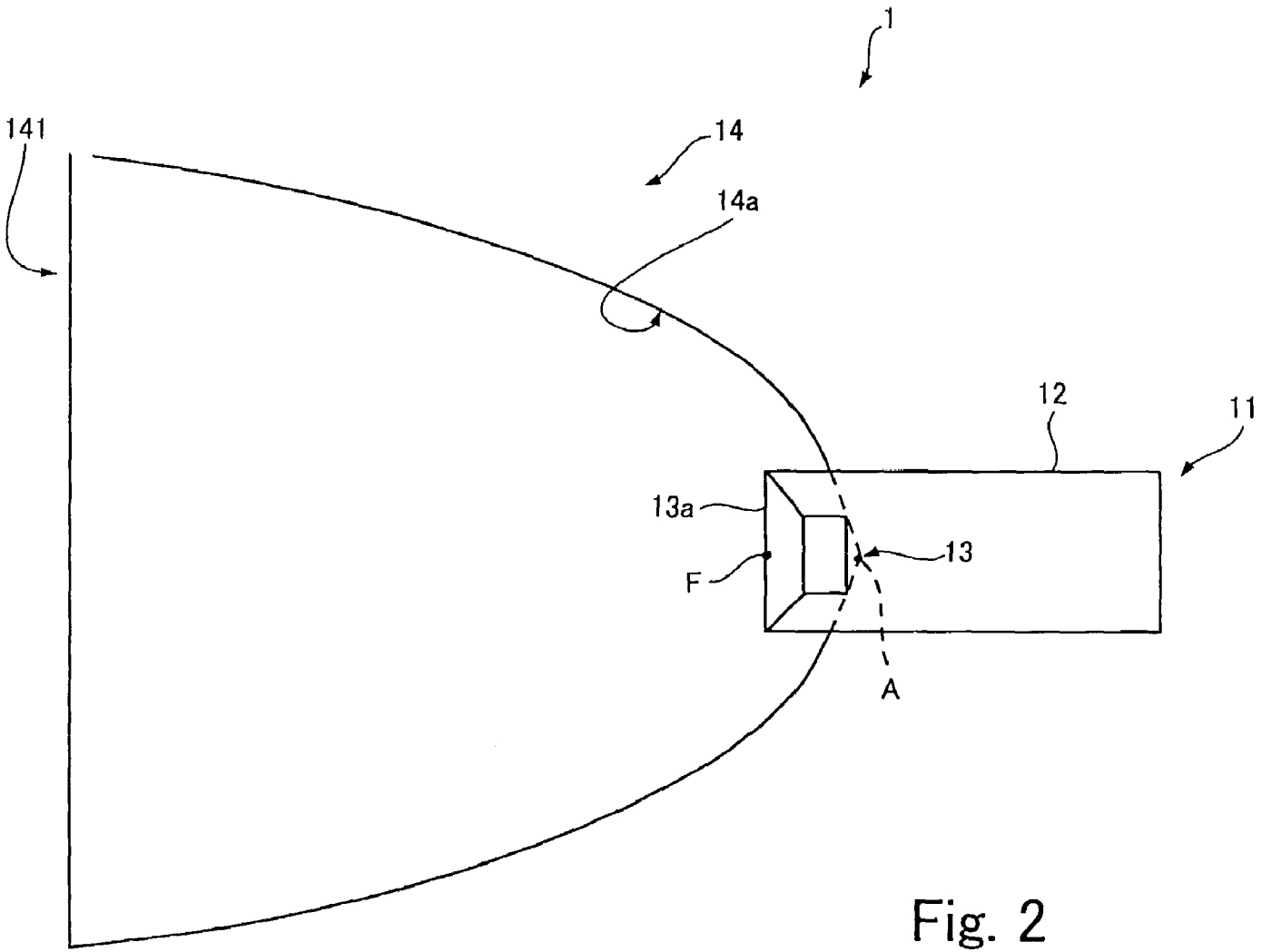
FIG. 2 is a schematic sectional view of a first embodiment of a speaker apparatus of the present invention.

FIG. 2 is a schematic sectional view of a first embodiment of a speaker apparatus of the present invention.

FIG. 2 representatively shows a sound processing section 11 having an electroacoustic transducer 13 having a vibrating surface 13*a* that vibrates on the basis of a signal having its amplitude amplified by an amplifier and a case 12 that holds the electroacoustic transducer 13. FIG. 2 also shows a hood 14 having an opening 141 and which focuses a sound emitted by the electroacoustic transducer 13 to emit the sound through the opening 141. The speaker 1 of this embodiment has the sound processing section 11 and the hood 14.

Figure 3:
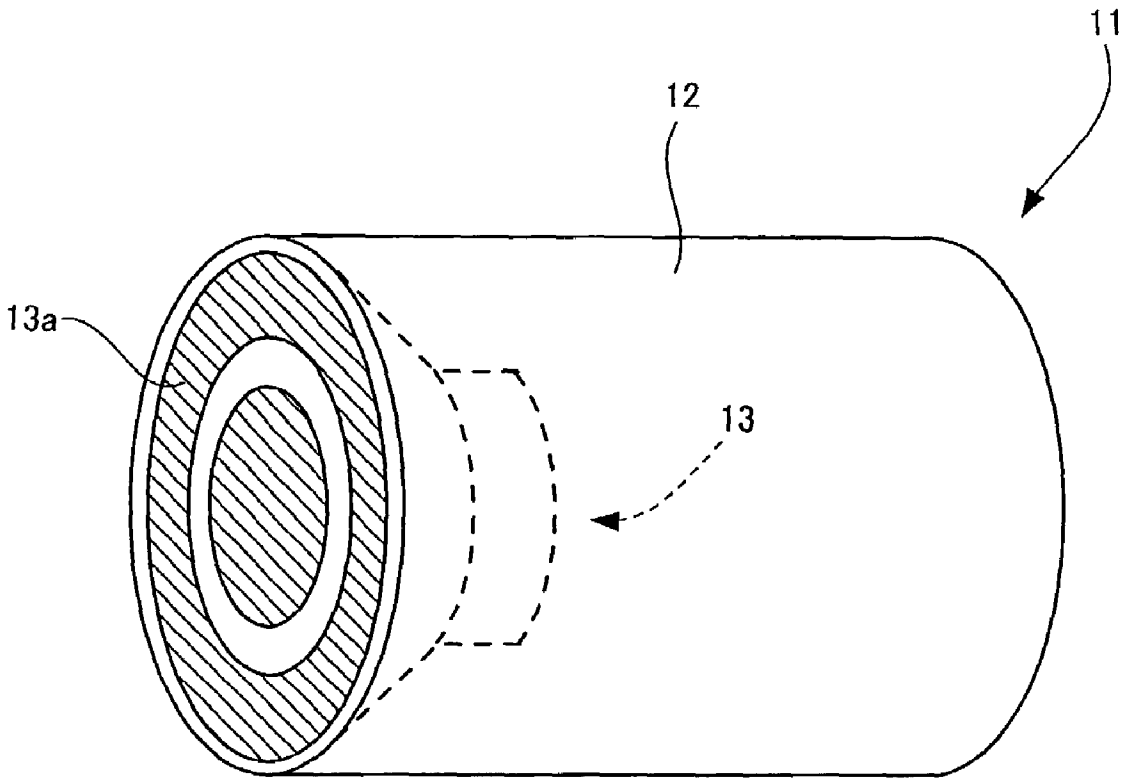
FIG. 3 is a perspective view of the appearance of a sound processing section shown in FIG. 2.

FIG. 3 is a perspective view of the appearance of the sound processing section shown in FIG. 2.

FIG. 3 shows the cylindrical sound processing section 11. The case 12 of the sound processing section 11 contains, for example, an amplifier (not shown) that amplifies a signal input, in addition to the electroacoustic transducer 13 having the vibrating surface 13*a* of diameter about 40 mm.

The hood 14, shown in FIG. 2, has a sound reflecting inner wall 14*a* shaped like a rotating surface and having a focus F behind the opening 141. The sound reflecting inner wall 14*a* reflects a sound emitted from the diaphragm 13*a* after having its amplitude amplified by the amplifier. The sound is thus focused and emitted to the outside through the opening 141 (diameter about 200 mm).

In the speaker 1 of the present embodiment, the vibrating surface 13*a* of the sound processing section 11 is placed at the focus F of the sound reflecting inner wall 14*a*.

Here, the distance between the focus F and a vertex A of the hood 14 lying opposite the opening 141 is defined as F0. The distance between the vibrating surface 13*a* of the sound processing section 11 and the vertex A is defined as L0. The distance between the vertex A and a position at which a sound wave emitted is focused best is defined as L. The relationship shown in Expression 2 is generally established between F0 and L0 and L.

$$1/F0=1/L0+1/L \qquad \text{(Expression 2)}$$

That is, when the vibrating surface 13*a* of the sound processing section 11 is placed at the focus of the sound reflecting inner wall 14*a*, the F0 is equal to the L0. Thus, in accordance with Expression 2, the L is an infinite value having an order different from that of the F0 or L0. Consequently, with the speaker 1, a person can hear the best focused sound wherever the person is within the seemingly practical range of the speaker 1 on the rotation axis of the sound reflecting inner wall 14*a* of the hood 14. The D in Expression 1 can be considered to be, instead of the diameter of the vibrating surface 13*a*, the diameter of the opening in the hood 14, which is larger than the diameter of the vibrating surface 13*a*.

Figure 4A:
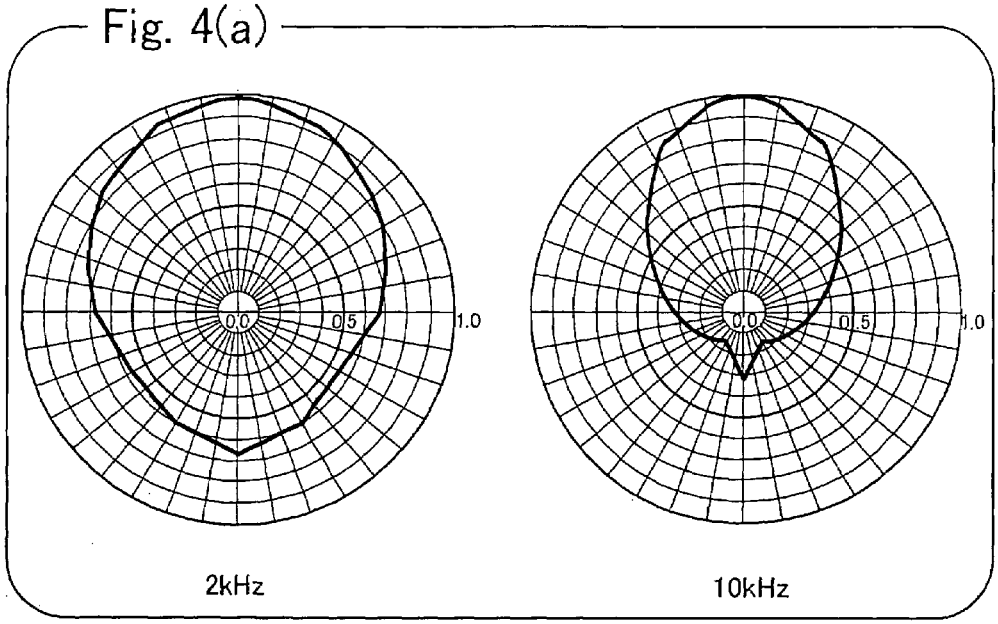
FIG. 4(*a*) is a graph showing the spread, outside a hood, of a sound emitted from the hood, that is, what is called a directional characteristic.
Figure 4B:
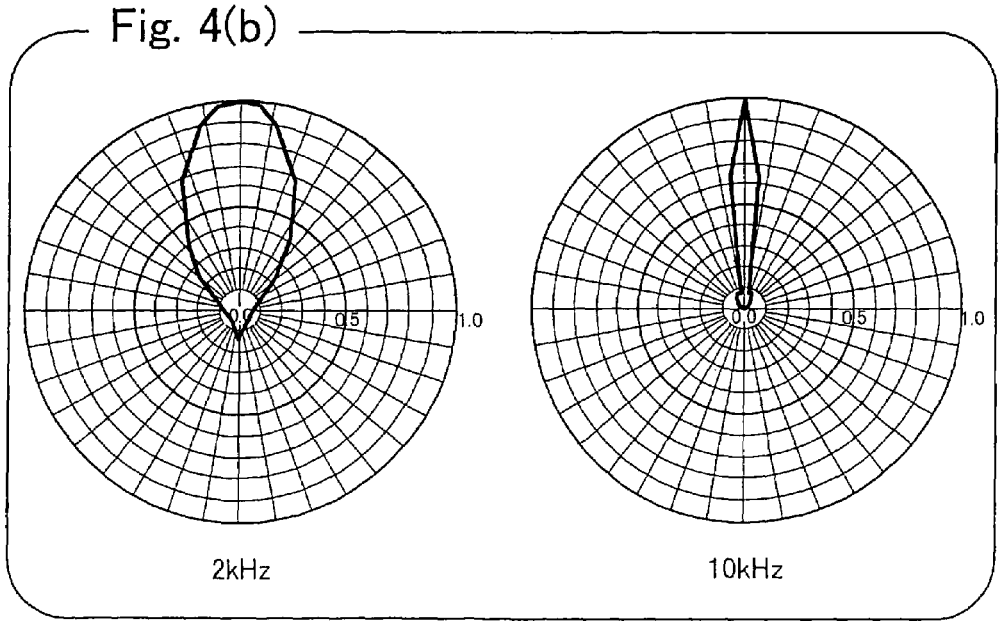

FIGS. 4(*a*) and 4(*b*) are graphs showing the spread, outside a hood, of a sound emitted from the hood, that is, what is called a directional characteristic.

Figure 1:
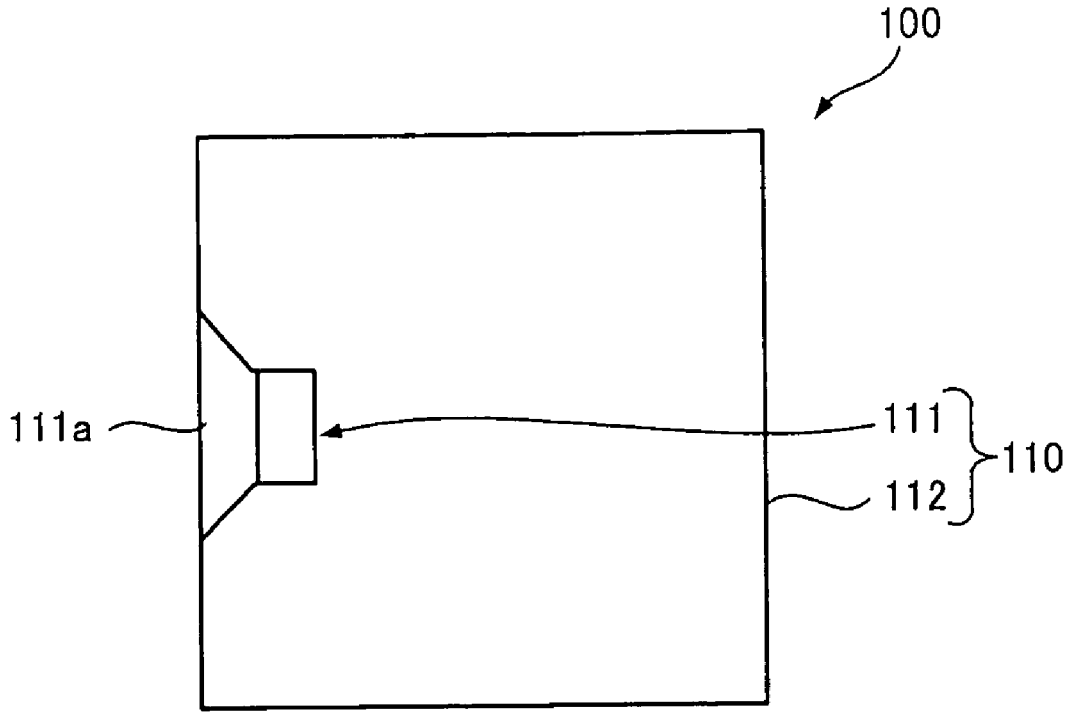
FIG. 1 is a schematic sectional view of a speaker conventionally commonly used.

FIG. 4(*a*) shows the directional characteristics of sounds of frequencies 2 kHz and 10 kHz emitted by the conventional speaker 100 shown in FIG. 1. FIG. 4(*b*) shows the directional characteristics of sounds of frequencies 2 kHz and 10 kHz emitted by the speaker 1 of the present embodiment shown in FIG. 2.

FIGS. 4(*a*) and 4(*b*) indicate that the speaker 1 of the present embodiment drastically improves the directivity of sounds of frequencies 2 kHz and 10 kHz.

The reason for the improvement is as follows. The speaker 1 of the present embodiment allows the D in Expression 1 to be considered to be, instead of the diameter of the vibrating surface 13*a*, the diameter of the opening 141 in the hood 14, which is sufficiently larger than the diameter of the vibrating surface 13*a*. Accordingly, an effective directional angle Φ (degree) in Expression 1 can be reduced by increasing the denominator of Expression 1. This can be clearly seen in the sound of the higher frequency (10 kHz) because this sound serves to reduce the numerator (wavelength λ) in Expression 1.

An example of the use of the speaker 1 is an exhibition hall where by using this speaker to describe exhibits at the booth of each company, it is possible to prevent the leakage of sound from booths to reduce noise in the entire exhibition hall.

Figure 5:
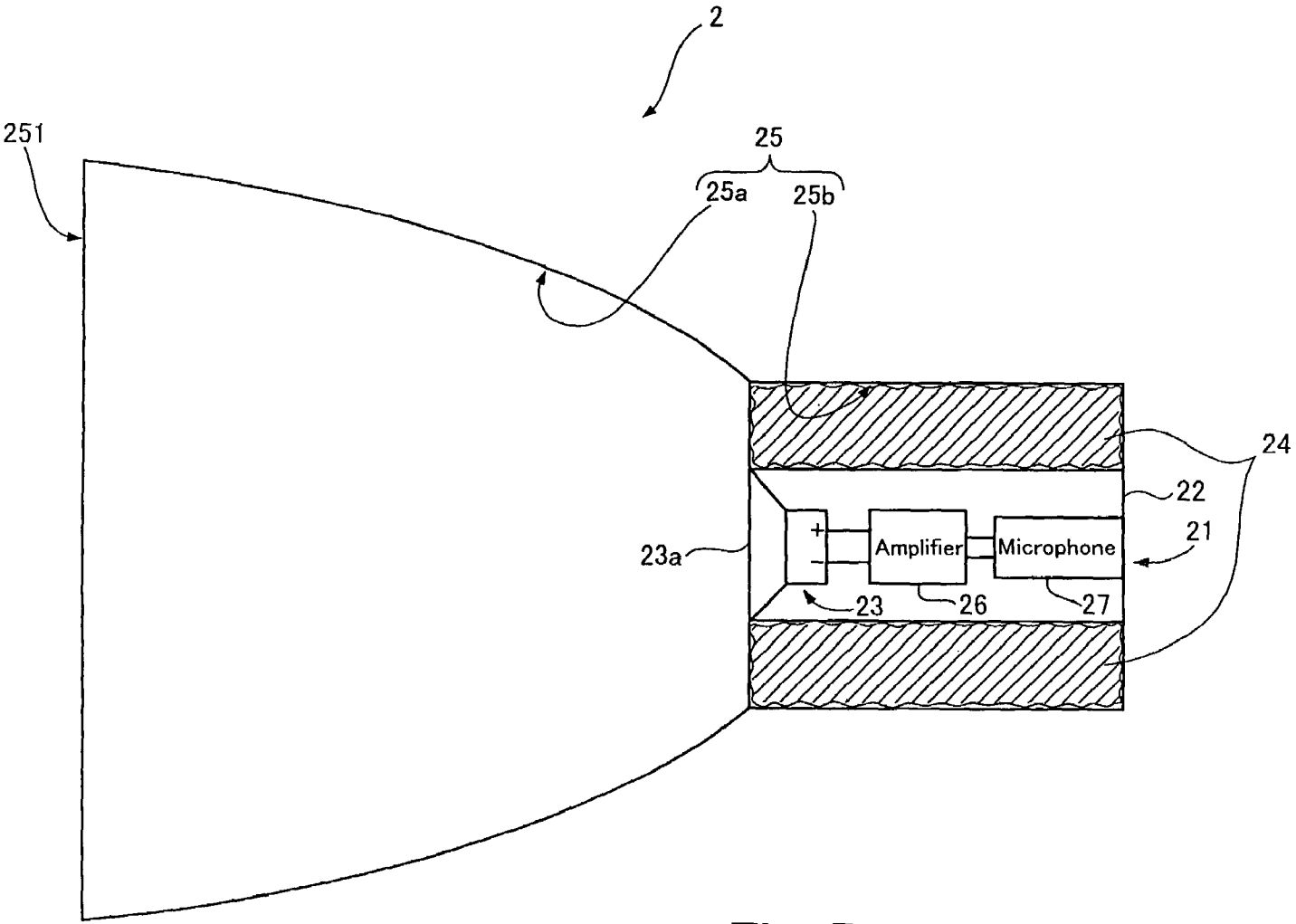
FIG. 5 is a sectional view of a second embodiment of a speaker apparatus of the present invention.

FIG. 5 is a schematic sectional view of a second embodiment of a speaker apparatus of the present invention.

FIG. 5 representatively shows a sound processing section 21 having a microphone 27 that detects sound or the like, an amplifier 26 that amplifies a signal detected by the microphone 27, an electroacoustic transducer 23 having a vibrating surface 23*a* that vibrates on the basis of a signal amplified by the amplifier 26, and a case 22 that holds the electroacoustic transducer 23, a hood 25 which has an opening 251 and which focuses a sound emitted by the electroacoustic transducer 23 and emits the sound through the opening 251, and glass wool 24 filled in the space formed between the hood 25 and the sound processing section 21. The speaker 2 of this embodiment has the sound processing section 21, the hood 25 and the glass wool 24.

The hood 25 is composed of a sound reflecting inner wall 25*a* shaped like a rotating surface and having a focus behind the opening 251 and a cylindrical sound absorbing material housing wall 25*b*.

The case 22 of the sound processing section 21 contains an amplifier and the like in addition to the electroacoustic transducer 23.

The glass wool 24 has a sound absorbing function and its surface is formed so as to have concaves and convexes to allow an incident sound wave to be efficiently absorbed.

Figure 6A:
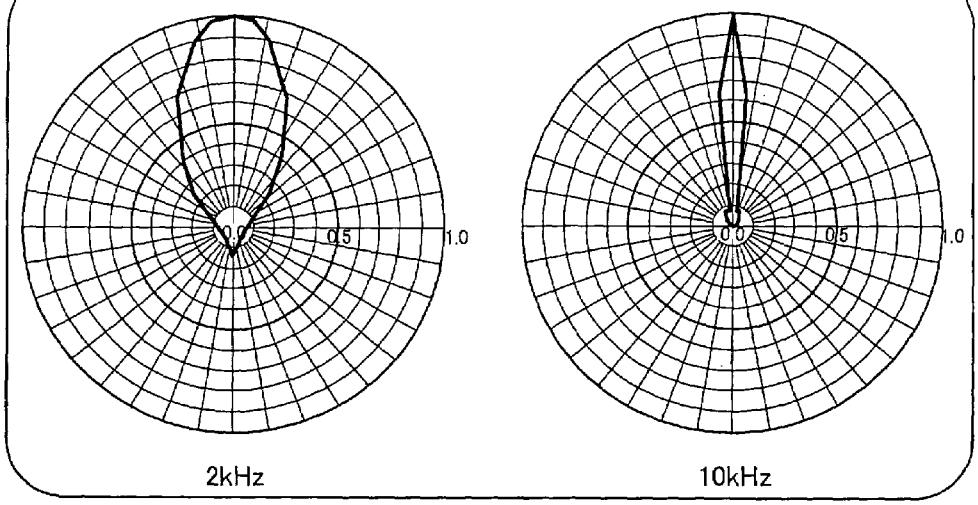
FIG. 6(*a*) is a graph showing the directional characteristic of sound.
Figure 6B:
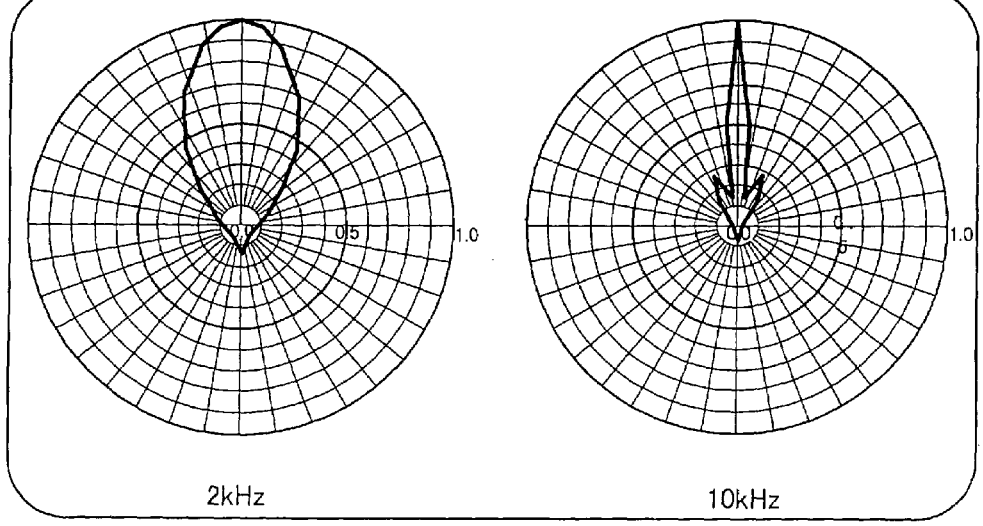

FIGS. 6(*a*) and 6(*b*) are graphs showing the directional characteristic of sound.

FIG. 6(*a*) is the same as FIG. 4(*b*) and shows the directional characteristics of sounds of frequencies 2 kHz and 10 kHz emitted by the speaker 1 according to the first embodiment shown in FIG. 2. FIG. 6(*b*) shows the directional characteristics of sounds of frequencies 2 kHz and 10 kHz emitted by a speaker 2 according to a second embodiment.

For the sound of frequency 2 kHz, no marked difference is observed between FIGS. 6(*a*) and 6(*b*). Compared to the speaker 1 of the first embodiment, the speaker 2 of the present embodiment further, though slightly, improves the directivity of the sound of frequency 10 kHz.

According to the speaker 2 of the present embodiment, multiple reflection occurring in the hood 25 can be absorbed and suppressed by the glass wool 24, placed so as to extend backward from the vibrating surface 23*a*. This contributes to improving the directivity and frequency characteristic. Further, in the speaker 2 of the present embodiment, the surface of the glass wool 24 has concaves and convexes to enable the irregular reflection of a sound incident on the surface or a sound traveling toward the interior of the hood after being absorbed. This contributes to improving a sound absorption efficiency.

Figure 7:
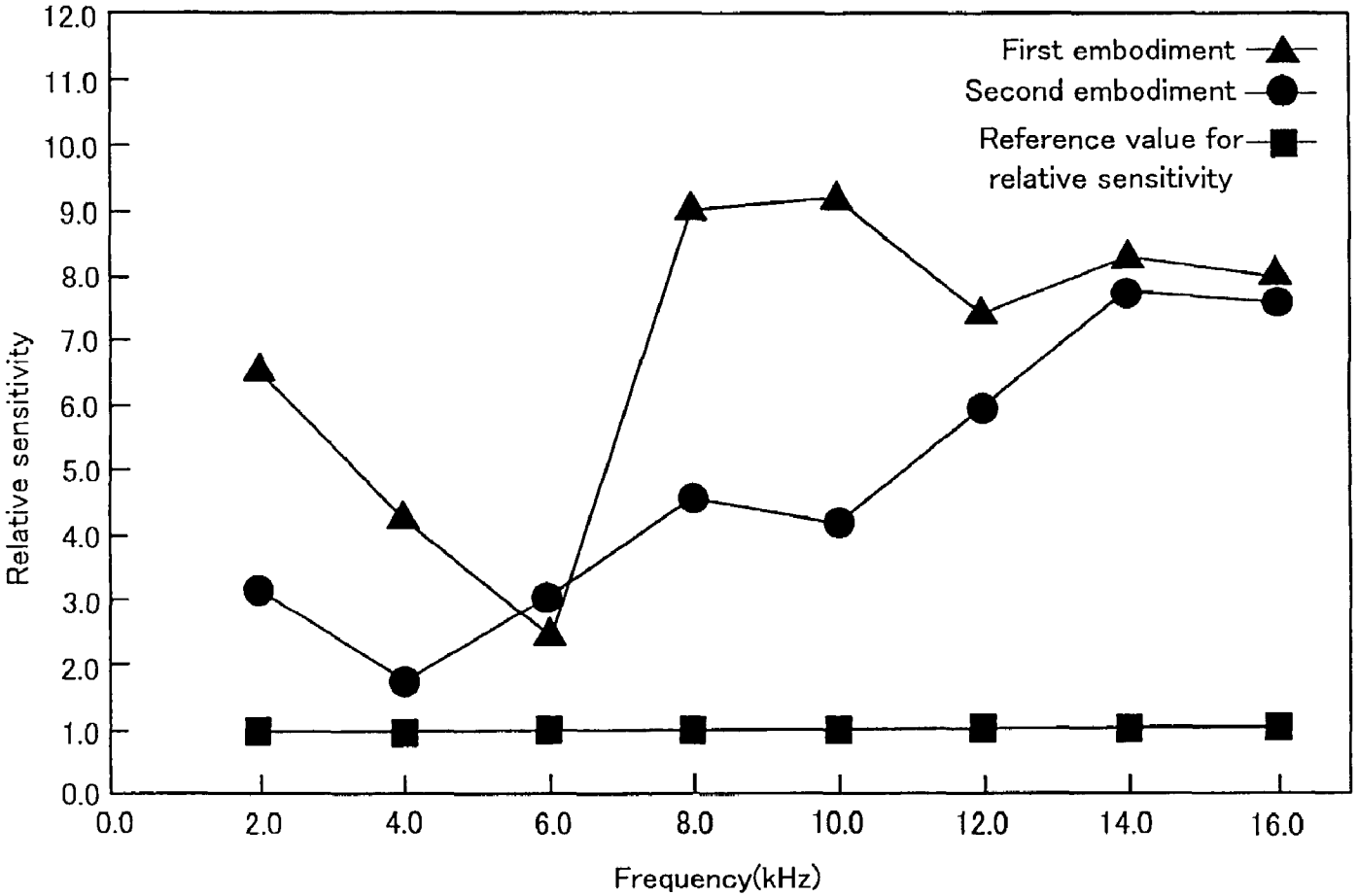
FIG. 7 is a graph showing the relative sensitivities of speakers of the first and second embodiments for each frequency.

FIG. 7 is a graph showing the relative sensitivities of speakers of the first and second embodiments for each frequency.

FIG. 7 is a graph showing the relative sensitivities of the speaker 1 of the first embodiment and the speaker 2 of the second embodiment for each frequency obtained by dividing, the sensitivities of these speakers as measured at the point of 1 m before the speaker on its central axis, by the frequency characteristic of the conventional speaker 100, shown in FIG. 1.

FIG. 7 shows a marked variation in the frequency characteristic of the speaker 1 of the first embodiment. The marked variation in relative sensitivity is due to standing waves of sound occurring in the hood and interfering with one another. On the other hand, for the speaker 2 of the second embodiment, having the glass wool, a sound absorbing material, in the hood, the relative sensitivity is flatter than that of the speaker 1 of the first embodiment. This is because the glass wool, placed in the hood, absorbs and attenuates standing waves occurring in the hood.

Figure 8:
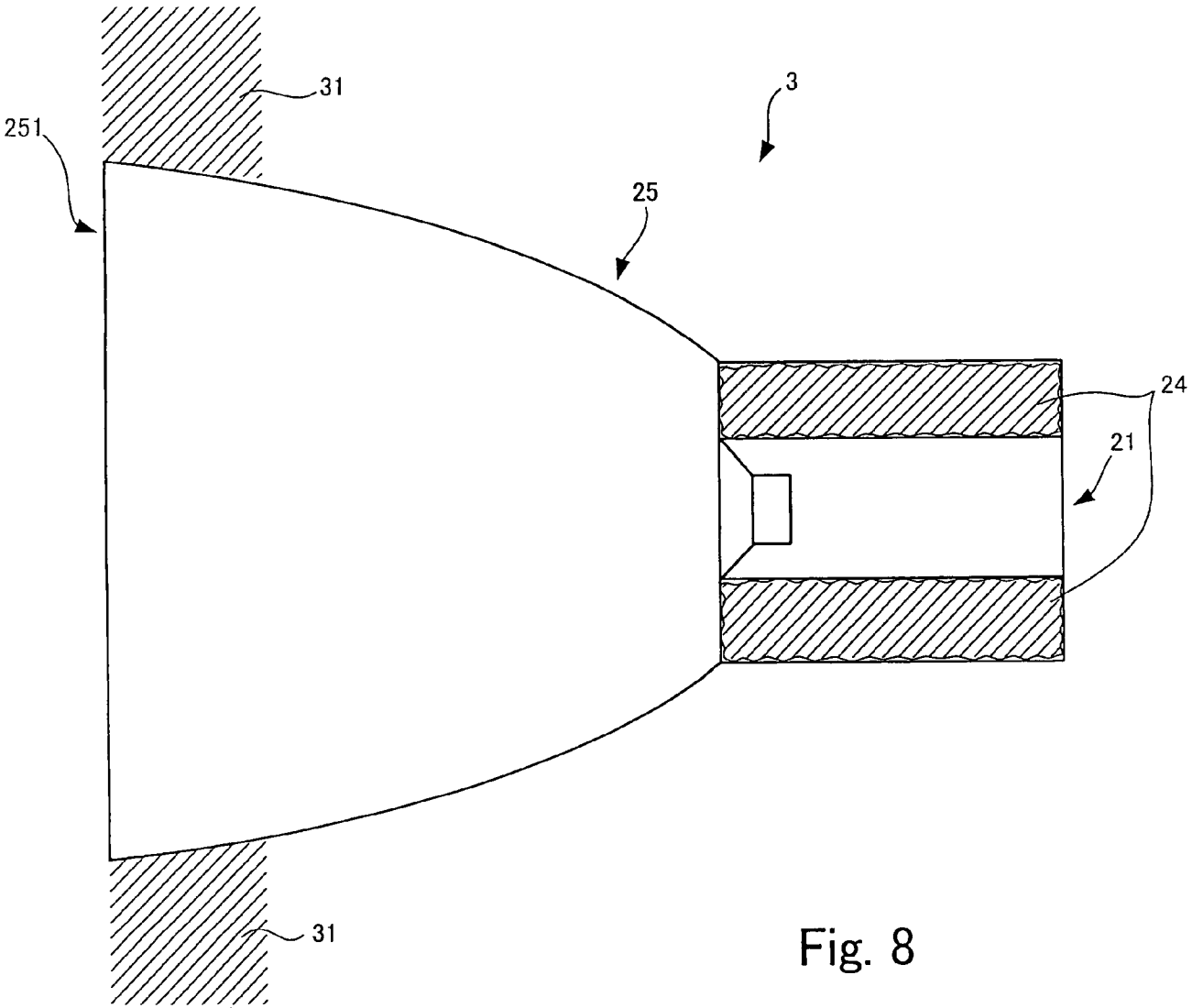
FIG. 8 is a sectional view of a third embodiment of the present invention.

FIG. 8 is a sectional view of a third embodiment of the present invention. Those members of the embodiment shown below which are of the same type as the corresponding members of the speaker 2 of the second embodiment are denoted by the same reference numerals as those used in the speaker 2 of the second embodiment.

A speaker 3 according to the third embodiment shown in FIG. 8 differs from the speaker 2 of the second embodiment only in that glass wool 31 is placed along the periphery of the opening in the hood. Those members shown in FIG. 8 which are of the same type as the corresponding members shown in FIG. 5 are denoted by the same reference numerals as those used in FIG. 5.

Figure 9:
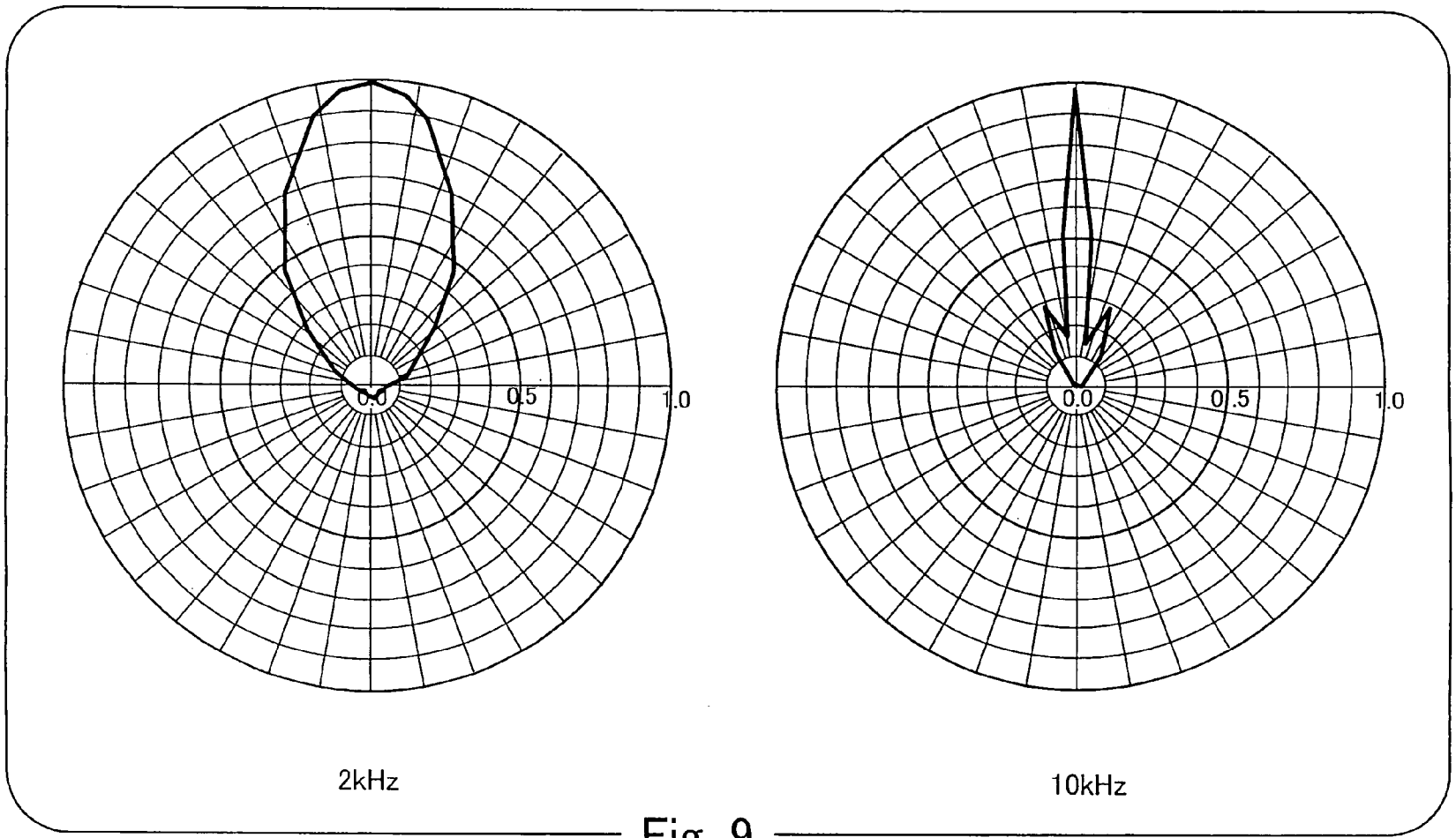
FIG. 9 is a graph showing the directional characteristic of a sound emitted by the speaker of the third embodiment.

FIG. 9 is a graph showing the directional characteristic of a sound emitted by the speaker of the third embodiment.

FIG. 9 shows the directional characteristic of sounds of frequencies 2 kHz and 10 kHz emitted by the speaker 3 according to the third embodiment of present invention, shown in FIG. 8. FIG. 9 indicates a decrease in emitted sound pressure for the frequency of 2 kHz toward the rear surface of the speaker, comparing with the speaker 2 of the second embodiment, shown in FIG. 6(*b*). This is because the glass wool 31, placed along the periphery of an opening 251 in the hood 25, absorbs and attenuates a diffracted wave traveling from the periphery of the opening 251 of the hood 25 toward the rear surface of the speaker.

Figure 10:
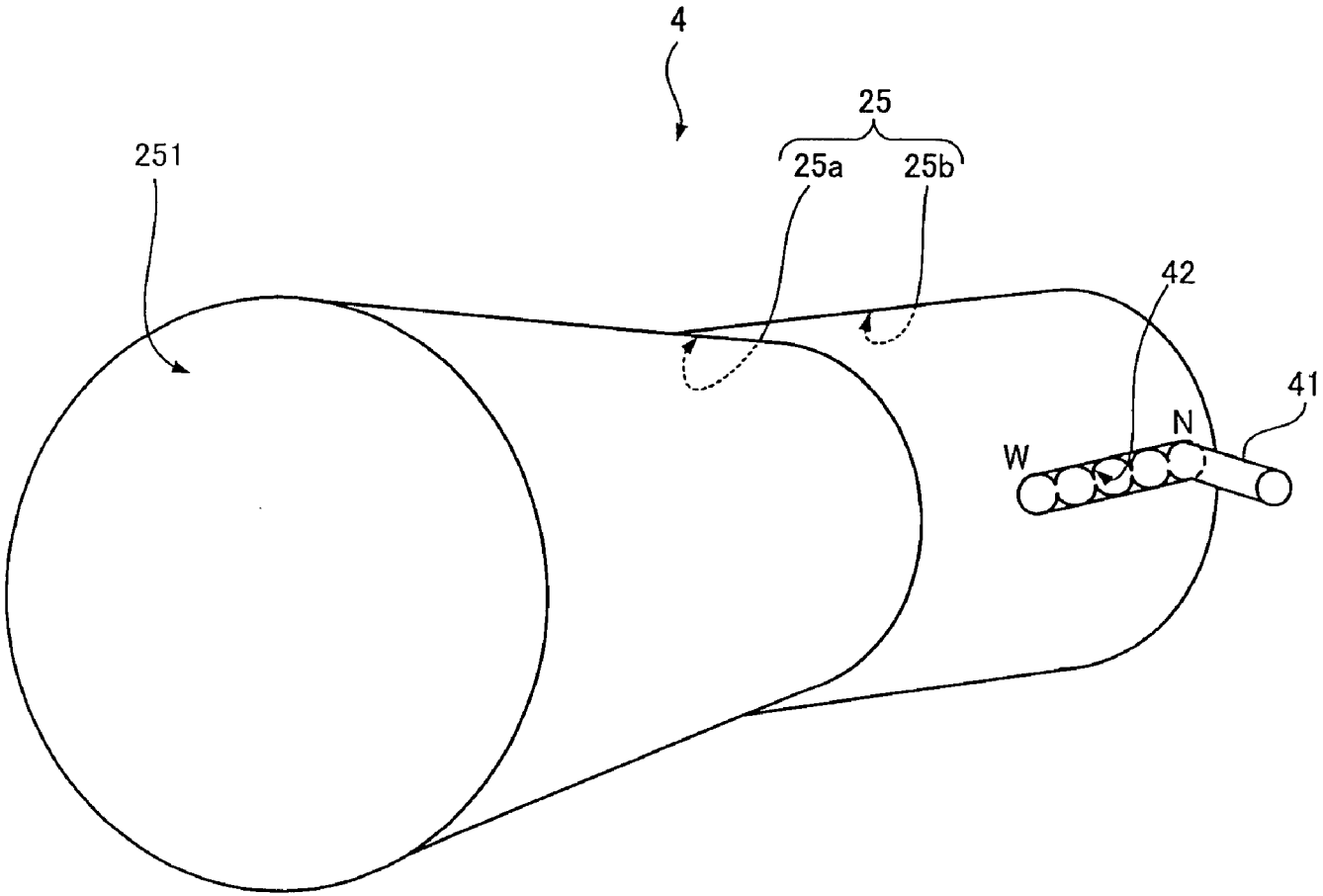
FIG. 10 is a perspective view of the appearance of a fourth embodiment of a speaker apparatus of the present invention.

FIG. 10 is a perspective view of the appearance of a fourth embodiment of a speaker apparatus of the present invention.

A speaker 4 according to the present embodiment is the speaker 2 of the second embodiment shown in FIG. 5 and which additionally has a mechanism for allowing the sound processing section 21 to freely move on the rotation axis of the sound reflecting inner wall 25*a* of the hood 25 in a longitudinal direction, the inner wall being shaped like a rotating surface.

FIG. 10 shows a lever 41 and a level locking mechanism 42 both provided on the cylindrical sound absorbing material housing wall 25*b* of the hood 25 to allow the movement of the sound processing section 21; the lever locking mechanism 42 locks the lever 41 on a step by step basis. The lever 41 is attached to a side of the case 22 of the sound processing section 21, accommodated inside the sound absorbing material housing wall 25*b*. In the speaker 4, the position of the lever 41 is changed between "W" (Wide) and "N" (Narrow) marked on a surface of the sound absorbing material housing wall 25*b* as shown in FIG. 10. This makes it possible to adjust the spread of sound outside the hood of the speaker 4. Although the details will be described later, the spread of sound outside the hood of the speaker 4 is larger as the lever 41 is closer to the "W", whereas the spread is smaller as the lever 41 is closer to the "N". In the speaker 4 when the lever 41 is placed at the N end the vibrating surface 23*a* of the sound processing section 21 coincides with the focus F of the sound reflecting inner wall 25*a* of the hood 25.

Figure 11:
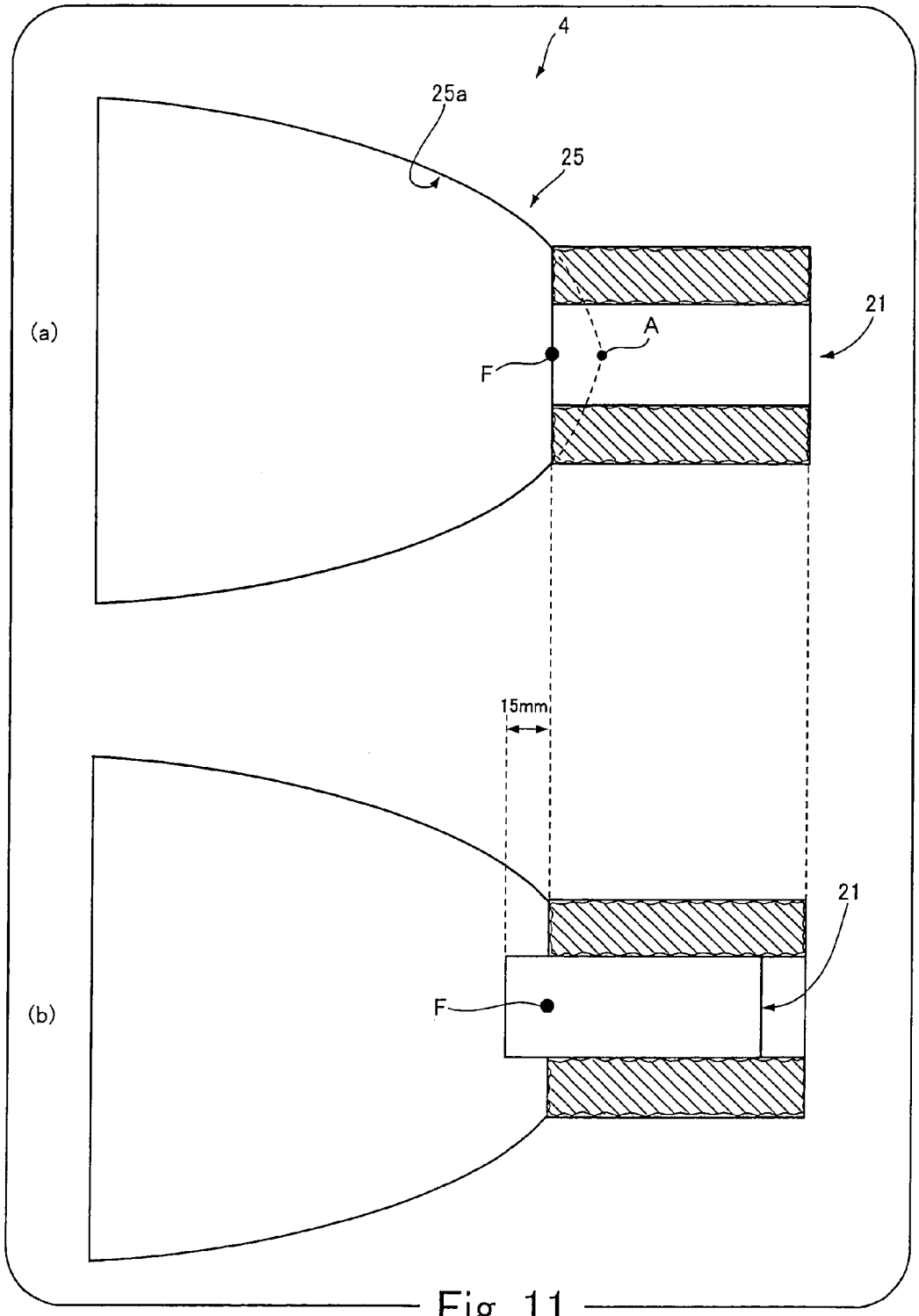
FIG. 11 is a sectional view of the fourth embodiment shown in FIG. 10.

FIG. 11 is a sectional view of the fourth embodiment shown in FIG. 10.

Part (a) of FIG. 11 is a sectional view of the speaker 4, in which the lever 41, shown in FIG. 10, is placed at the N end. Part (b) of FIG. 11 is a sectional view of the speaker 4, in which the lever 41, shown in FIG. 10, is shifted to the W end.

As previously described, the distance F0 between the focus F and the vertex A of the hood 25 lying opposite the opening 251 is a constant determined by the shape and size of the hood 25. In the speaker 4, by moving the vibrating surface 23*a* of the sound processing section 21 to adjust the distance between the vibrating surface 23*a* and the vertex A of the hood 25 to vary the L0, it is possible that the position L at which a sound emitted is focused best has an arbitrary value which is not infinite and which has an order similar to that of the F0 or L0. Therefore, in the speaker 4, moving the lever 41 from "N" to "W" enables a sound emitted from the hood 25 to be focused best at a position on the axis which is close to the opening 251 in the hood 25. This makes it possible to diffuse a sound reaching a remote position on the axis which position is included in the practical range of the speaker 4. Consequently, the sound can be obtained in an out-of-focus state. Thus, according to the speaker 4, when the vibrating surface 23*a* coincides with the focus F as shown in Part (a) of FIG. 11, a decrease in sound pressure in a high frequency area can be suppressed by shifting the position of the vibrating surface 23*a* from the focus F; owing to the high directivity, the decrease in sound pressure occurs even when a hearing position deviates slightly in the axial direction of the hood 25. Therefore, the speaker 4 can prevent tone colors perceived by the person from being extremely varied by a slight change in hearing direction.

Part (b) of FIG. 11 is a sectional view of the speaker 4 in which the lever 41 is brought to the "W" to move the vibrating surface 23*a* 15 mm from the focus F toward the opening of the hood 25.

Figure 12:
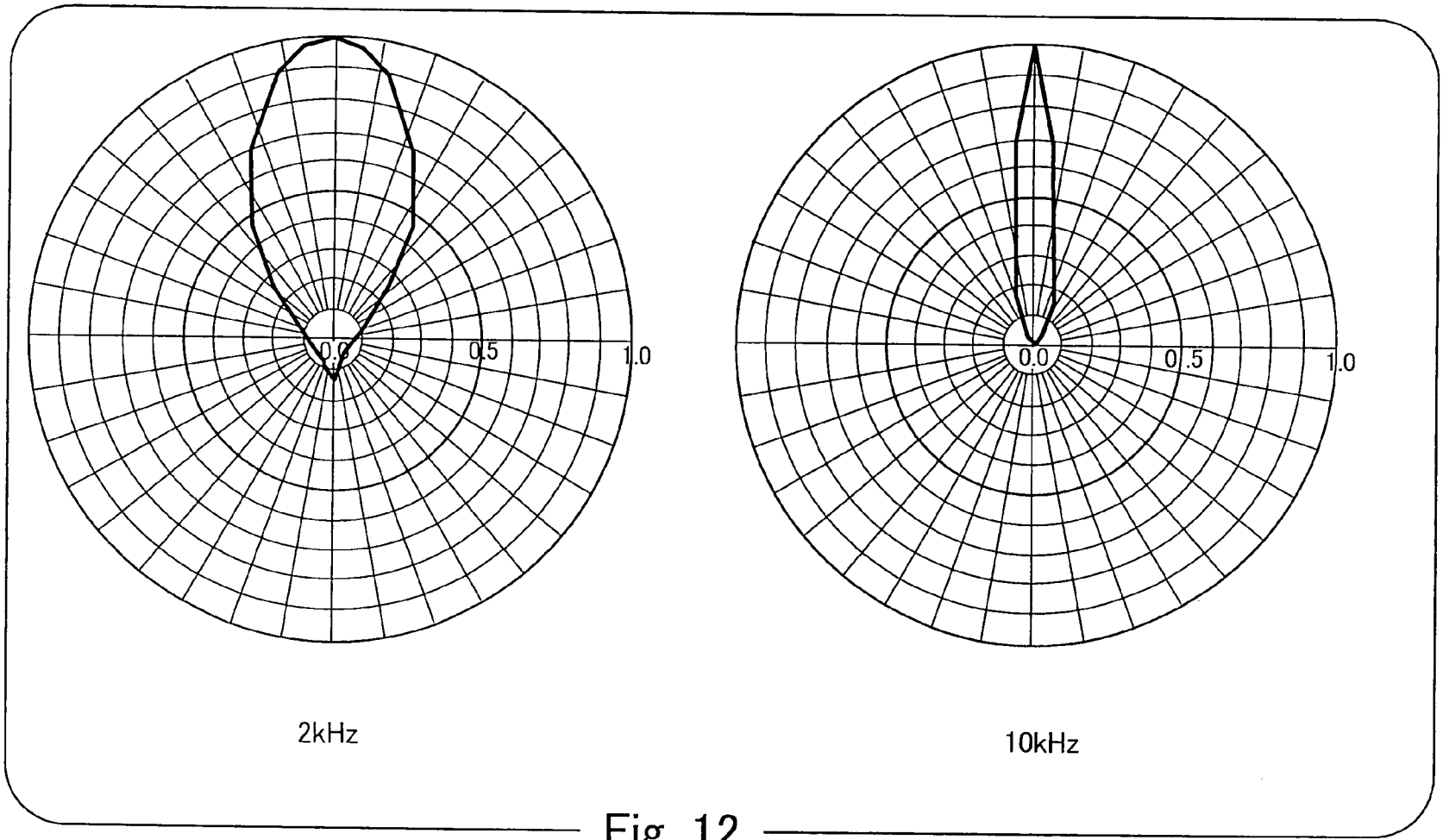
FIG. 12 is a graph showing the directional characteristic of the speaker of the fourth embodiment.

FIG. 12 is a graph showing the directional characteristic of the speaker of the fourth embodiment.

FIG. 12 shows the directional characteristics of sounds of frequencies 2 kHz and 10 kHz emitted by the speaker 4 of the fourth embodiment in which the vibrating surface 23*a* has been moved 15 mm from the focus F toward the opening of the hood 25 as shown in Part (b) of FIG. 11; the directional characteristics were measured at a position lying 1 m before the opening of the hood on its axis.

For the frequency of 2 kHz, no marked difference is observed between the directional characteristic shown in FIG. 12 and that of the speaker 2 of the second embodiment, shown in FIG. 6(*b*). However, for the frequency of 10 kHz, FIG. 12 shows the spread of the directivity caused by the out-of-focus state, described above.

In this manner, in the speaker 4 of the fourth embodiment, the directivity is controlled by moving the vibrating surface 23*a* of the sound processing section 21.

Now, description will be given of a fifth embodiment of a speaker of the present invention.

Figure 13:
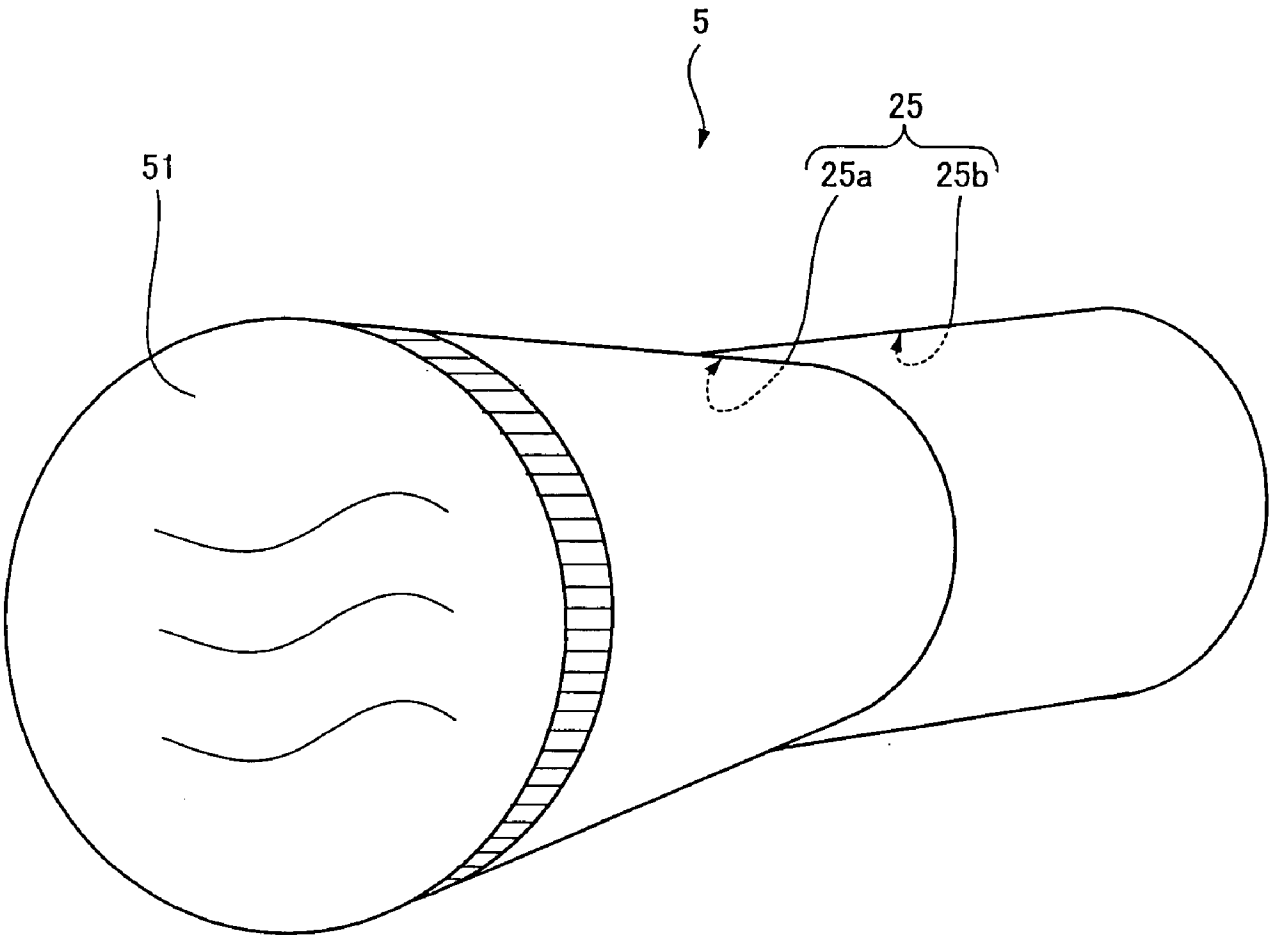
FIG. 13 is a perspective view of the appearance of a speaker of a fifth embodiment.

FIG. 13 is a perspective view of the appearance of the speaker of the fifth embodiment.

FIG. 13 is a perspective view of the appearance of the speaker 5 of the present embodiment. This speaker 5 is the speaker 2 of the second embodiment in which a thin sheet-like member 51 is attached to the opening of the hood in order to prevent the contamination of an inner surface of the hood 25 and the vibrating surface 23*a* of the sound processing section 21 and to avoid the adverse effect of an atmospheric gas.

Figure 14A:
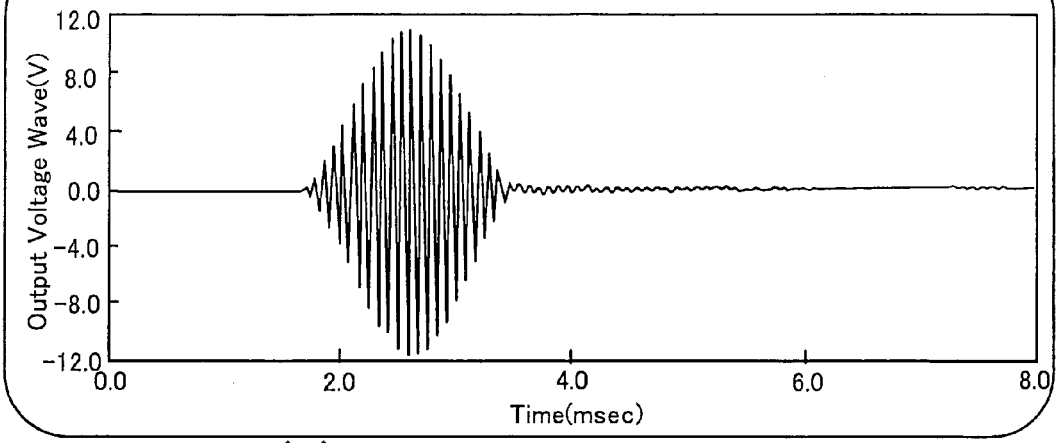
FIG. 14(*a*) is a diagram showing a sound pressure waveform obtained in front of the hood if a predetermined tone burst signal is applied to the speaker of the fifth embodiment.
Figure 14B:
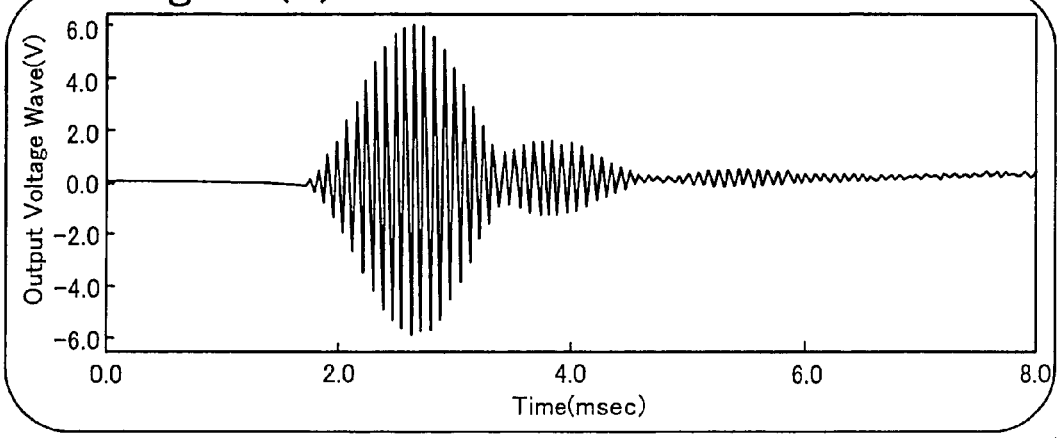
Figure 14C:
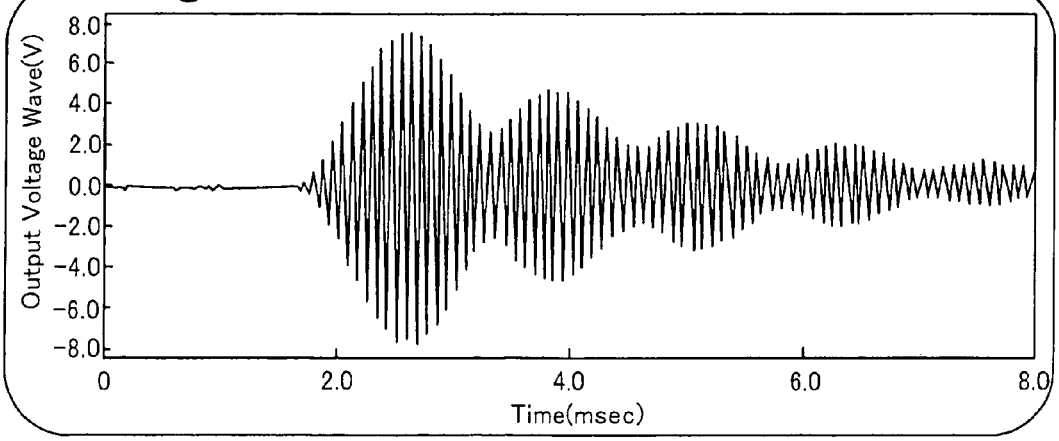

FIGS. 14(*a*) to 14(*c*) are diagrams showing sound pressure waveforms obtained in front of the hood if a predetermined tone burst signal is applied to the speaker of the fifth embodiment.

FIG. 14(*a*) shows a sound pressure waveform measured 1 m before the opening of the hood on its axis, for comparison, if a tone burst signal of frequency 12 kHz and duration 2 ms is applied to the speaker 2 of the second embodiment, shown in FIG. 5. FIG. 14(*b*) shows a sound pressure waveform measured under the same conditions for a speaker 5 of the present embodiment 5 of the present embodiment shown in FIG. 13. FIG. 14(*c*) shows a sound pressure waveform measured by applying, for comparison, the thin sheet-like member 51 to the opening of the hood of the speaker 1 of the first embodiment, shown in FIG. 2.

The sound pressure waveform in FIG. 14(*a*) is considered to be almost similar to that of a signal applied.

A comparison of FIG. 14(*b*) with FIG. 14(*c*) indicates that when the sheet-like member 51 is applied to the opening of the hood, a significant difference is observed between the case in which the glass wool, a sound absorbing material, is provided and the case in which it is not provided. FIG. 14(*c*) shows a trailing sound pressure waveform that is totally different from the waveform shown in FIG. 14(*a*) because the absence of the sound absorbing material in the hood precludes the absorption of the multiple reflection occurring between the inner wall of the hood and the sheet-like member. FIG. 14(*b*) shows a waveform that is more similar to the one shown in FIG. 14(*a*) than the one shown in FIG. 14(*c*) because the sound absorbing material provided in the hood enables the absorption of the multiple reflection occurring between the inner wall of the hood and the sheet-like member.

In this manner, according to the speaker 5 of the present embodiment, the sound absorbing material such as glass wool is provided inside the hood. This not only improves the directivity but also minimizes the adverse effect of a sheet-like material provided in order to prevent the contamination of the vibrating surface.

Figure 15:
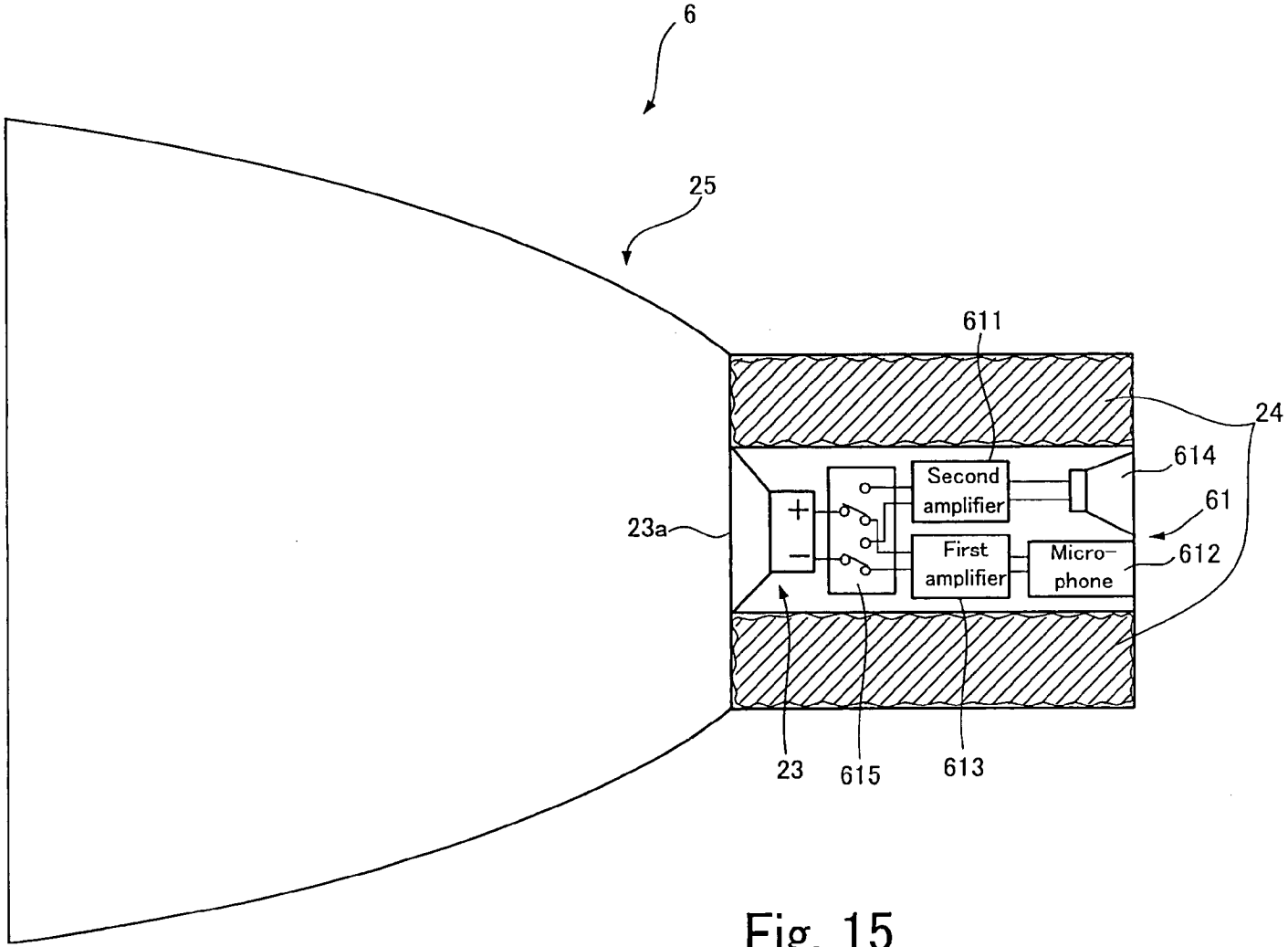
FIG. 15 is a schematic sectional diagram of a sixth embodiment of the present invention.

FIG. 15 is a schematic sectional diagram of a sixth embodiment of the present invention.

A speaker 6 of the present embodiment shown in FIG. 15 has the same appearance as that of the speaker 2 of the second embodiment, shown in FIG. 5. However, in the speaker 6, a sound processing section 61 having the vibrating surface 23*a* has components different from those in the speaker 2.

The sound processing section 61 of the speaker 6, shown in FIG. 15, is mainly composed of a first electroacoustic transducer 23 having the vibrating surface 23*a*, a first amplifier 613 that amplifies a signal to be transmitted to the first electroacoustic transducer 23, a microphone 612 that detects a sound signal to be transmitted to the first amplifier 613, a second amplifier 611 that amplifies a signal detected by the first electroacoustic transducer 23 based on a sound entering the hood, a second electroacoustic transducer 614 that emits sound on the basis of the signal amplified by the second amplifier 611, and a switch 615 that switches a signal transmission between the first electroacoustic transducer 23 and each of the two amplifiers.

In the speaker 6, with the above configuration, when a sound or the like is input to the microphone 612, the switch 615 switches connections so as to transmit a signal from the first amplifier 613 to the first electroacoustic transducer 23. On the other hand, when the first electroacoustic transducer 23 detects a sound entering the hood, the switch 615 switches the connections so as to communicate the signal detected by the first electroacoustic transducer 23 to the second amplifier 611.

Figure 16:
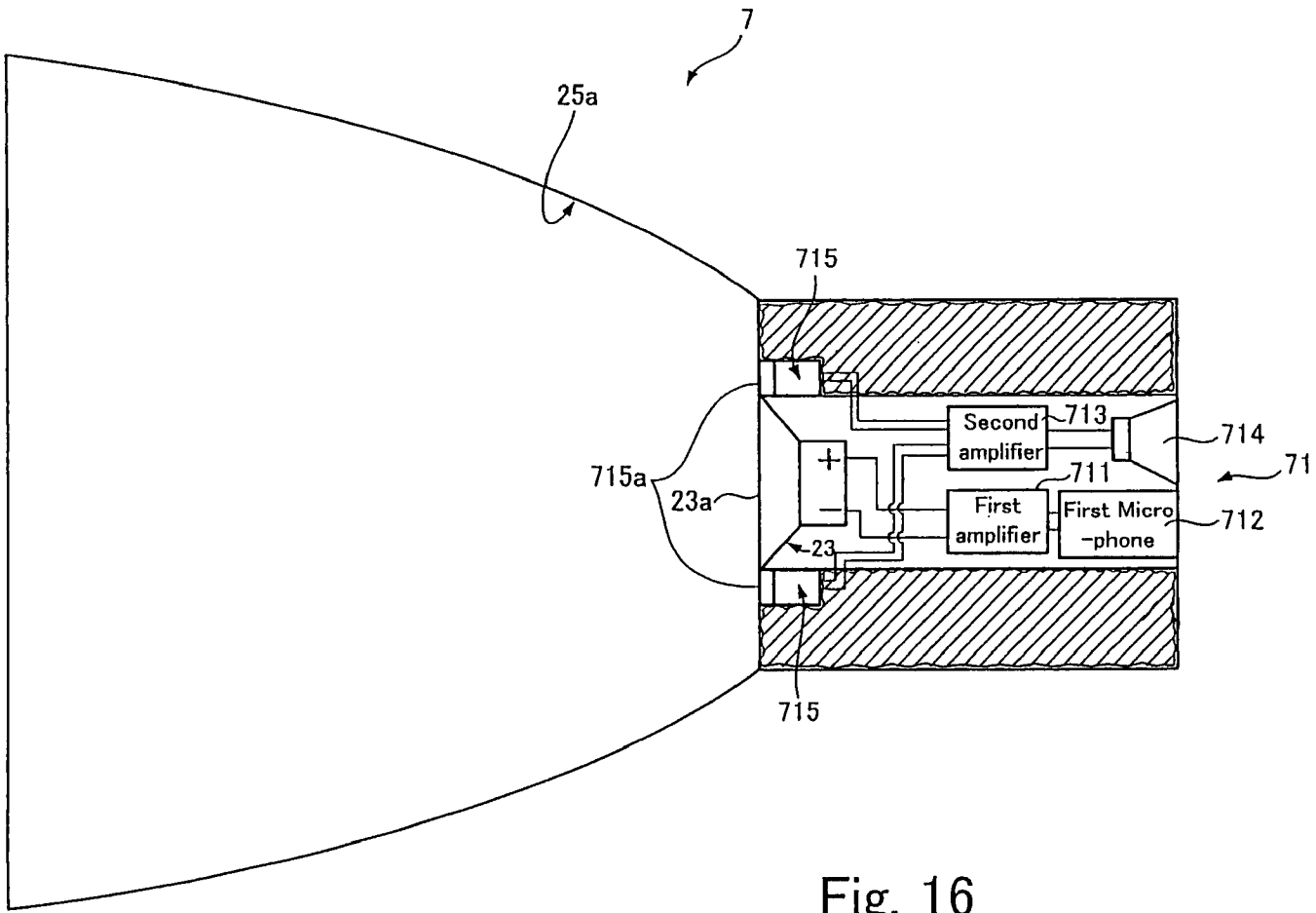
FIG. 16 is a schematic sectional diagram of a seventh embodiment of the present invention.

FIG. 16 is a schematic sectional diagram of a seventh embodiment of the present invention.

In the speaker 6 of the sixth embodiment, shown in FIG. 15, the first electroacoustic transducer 23 is used to emit and collect sound. However, in a speaker 7 of the present embodiment shown in FIG. 16, a second microphone 715 is provided around the first electroacoustic transducer 23 to receive sound. The first electroacoustic transducer 23 is used solely to emit sound.

A sound processing section 71 of the speaker 7, shown in FIG. 16, is mainly composed of the first electroacoustic transducer 23 having the vibrating surface 23*a*, a first amplifier 711 that amplifies a signal to be transmitted to the first electroacoustic transducer 23, a first microphone 712 that detects a sound signal to be transmitted to the first amplifier 711, a second amplifier 713 that amplifies a signal on the basis of the sound entering the hood and detected by the second microphone 715, and a second electroacoustic transducer 714 that emits sound on the basis of the signal amplified by the second amplifier 713.

In the speaker 7 configured as described above, the second microphone 715, having an annular sound receiving surface, is placed in the outer periphery of the vibrating surface 23*a* of the first electroacoustic transducer 23. Accordingly, operations of a speaker and operations of a sound receiver can be performed in parallel without switching the wiring. Desirably, the vibrating surface 23*a* of the first electroacoustic transducer 23 and a sound receiving surface 715*a* of the microphone 715 are concentrically arranged. However, these surfaces need not necessarily be concentrically arranged. Further, the vibrating surface 23*a* need not be shaped like a circle or a ring. Furthermore, the second microphone 715 may be located inside the vibrating surface 23*a* of the first electroacoustic transducer 23.

For example, the speakers 6 and 7 of the sixth and seventh embodiments, respectively, may be used in a pinball parlor; when a player at each pinball machine communicates with a clerk, they can communicate in spite of a heavy noise while preventing the players at the adjacent pinball machines from hearing their dialog. This is useful for the transmission of instructions and responses in a noisy factory or construction site. It is also convenient for the communication between a client at a cash dispenser and a bank clerk.

Figure 17:
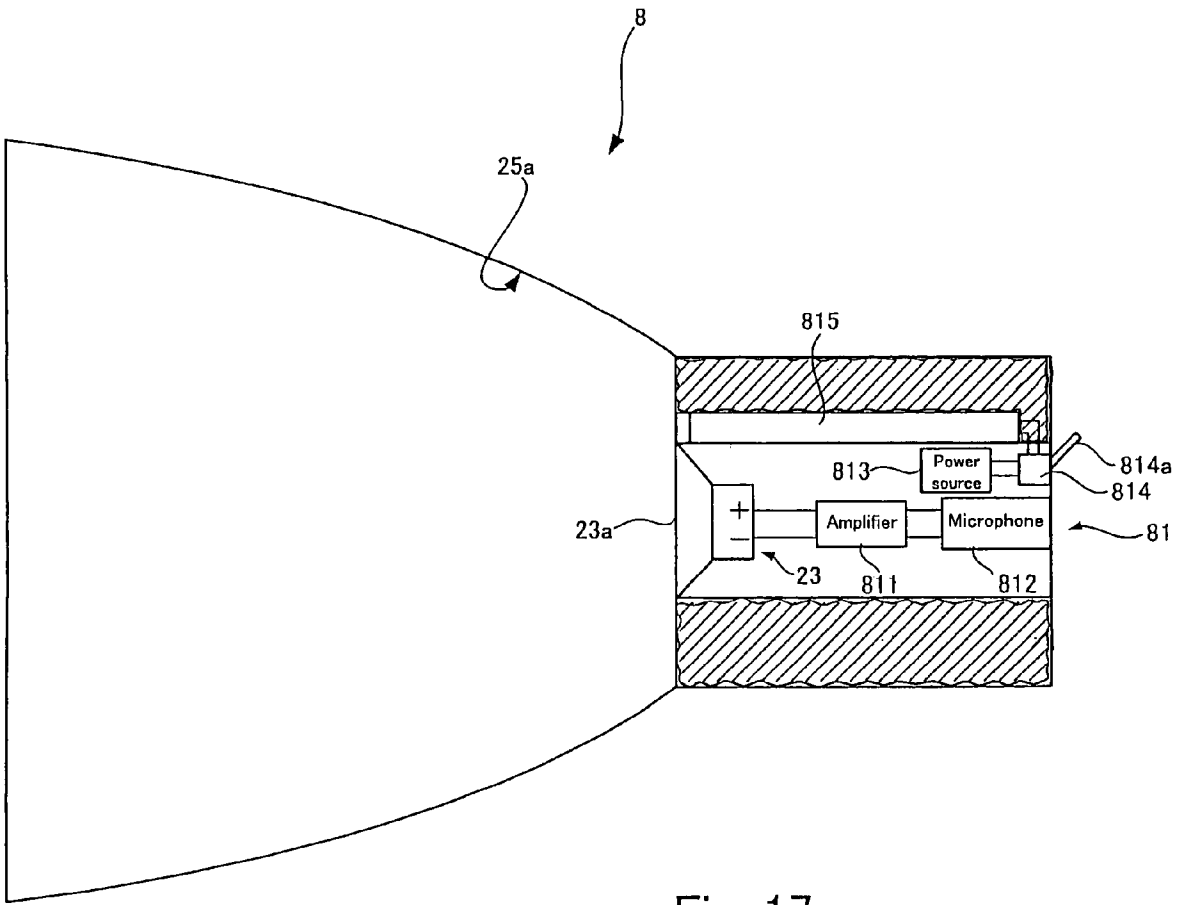
FIG. 17 is a schematic sectional diagram of an eighth embodiment of the present invention.

FIG. 17 is a schematic sectional diagram of an eighth embodiment of the present invention.

A speaker 8 of the eighth embodiment, shown in FIG. 17, does not have a sound receiving function but only emits sound. However, the speaker 8 has a light beam emitter 815 that emits a light beam parallel to the rotation axis of the sound reflecting inner wall 25*a* of the hood 25, the rotation axis being shaped like a rotating surface.

A sound processing section 81 of the speaker 8 is mainly composed of the electroacoustic transducer 23 having the vibrating surface 23*a*, an amplifier 811 that amplifies a signal to be transmitted to the electroacoustic transducer 23, a microphone 812 that detects, for example, a sound signal to be transmitted to the amplifier 811, a power source 813 for the light beam emitter, and a switch section 814 having a switch lever 814*a* operated to control operations of the light beam emitter 815.

In the speaker 8, the light beam emitter 815 can emit a light beam parallel to the rotation axis of the sound reflecting inner wall 25*a*. This is useful for utilizing the narrow directivity of the speaker apparatus of the present invention. The light beam emitter 815 may be freely removed from the speaker 8.

Figure 18:
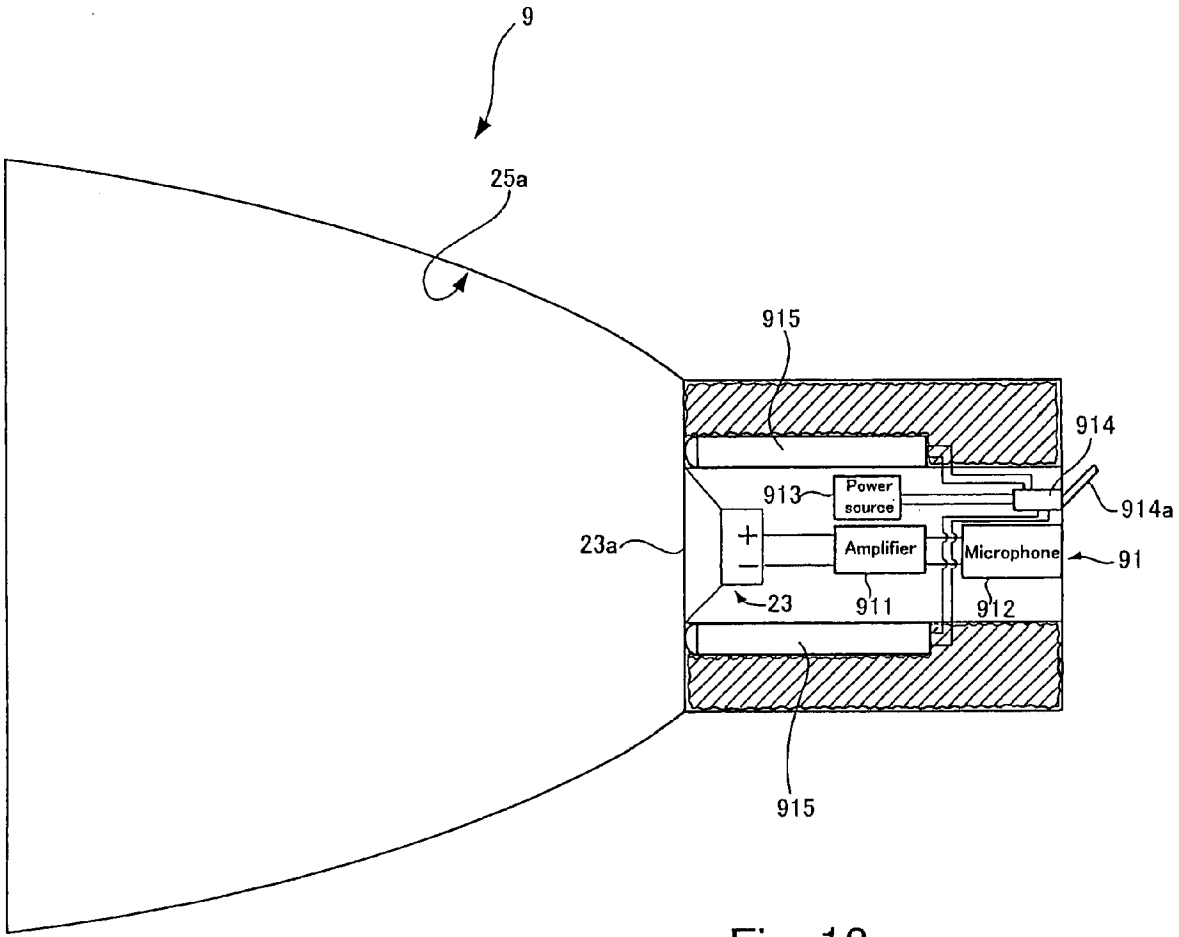
FIG. 18 is a schematic sectional diagram of a ninth embodiment of the present invention.

FIG. 18 is a schematic sectional diagram of a ninth embodiment of the present invention.

A speaker 9 of the ninth embodiment, shown in FIG. 18, does not have a sound receiving function but only emits sound, as in the case of the speaker 8 of the eighth embodiment. However, a light emitter 915 is provided in the hood to emit light to the exterior of the hood.

A sound processing section 91 of the speaker 9 is mainly composed of the electroacoustic transducer 23 having the vibrating surface 23*a*, an amplifier 911 that amplifies a signal to be transmitted to the electroacoustic transducer 23, a microphone 912 that detects a sound signal to be transmitted to the amplifier 911, a power source 913 for the light emitter, and a switch section 914 having a switch lever 914*a* operated to control operations of the light emitter 915.

The speaker 9 of the ninth embodiment can irradiate an object with light collected by the sound reflecting inner wall 25*a* after being emitted by the light emitter 915 from the interior to exterior of the hood. The light emitter 915 may also be freely removed from the speaker 9.

The speaker 9 may be used in, for example, a museum; the speaker 9 is installed above exhibits, and when a separately installed infrared sensor detects a visitor approaching the exhibits, the light emitter 915 emits light, while the speaker 9 outputs description of the exhibits, music, or the like. This enables the description to be given only to the vicinity of the exhibits and also enables the exhibits to be illuminated. Accordingly, the description and the illumination are unlikely to disturb other visitors.

Figure 19:
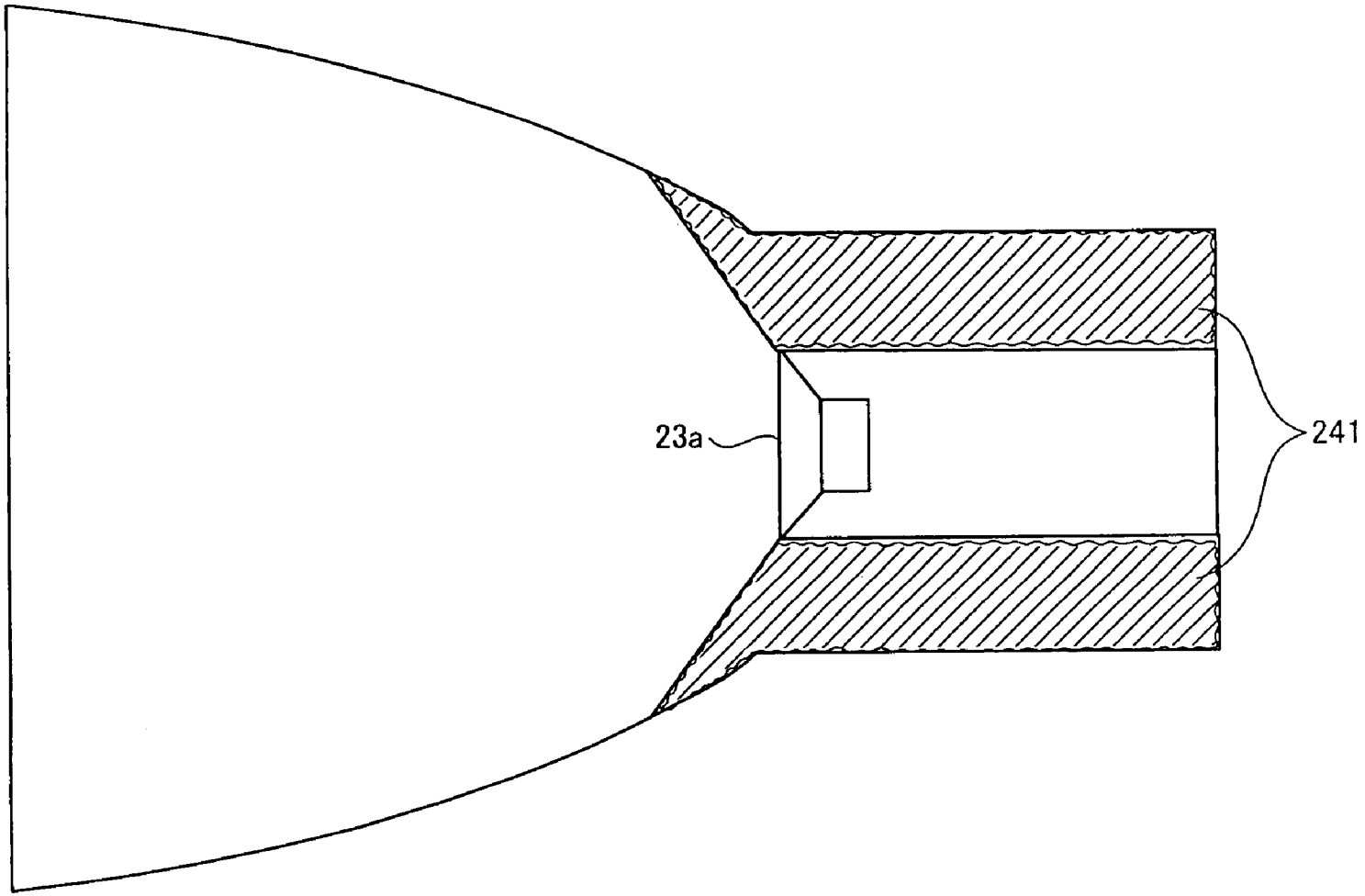
FIG. 19 is a diagram showing another aspect of the embodiment of the speaker apparatus of the present invention, the aspect relating to the form of glass wool that is a sound absorbing material.
Figure 20:
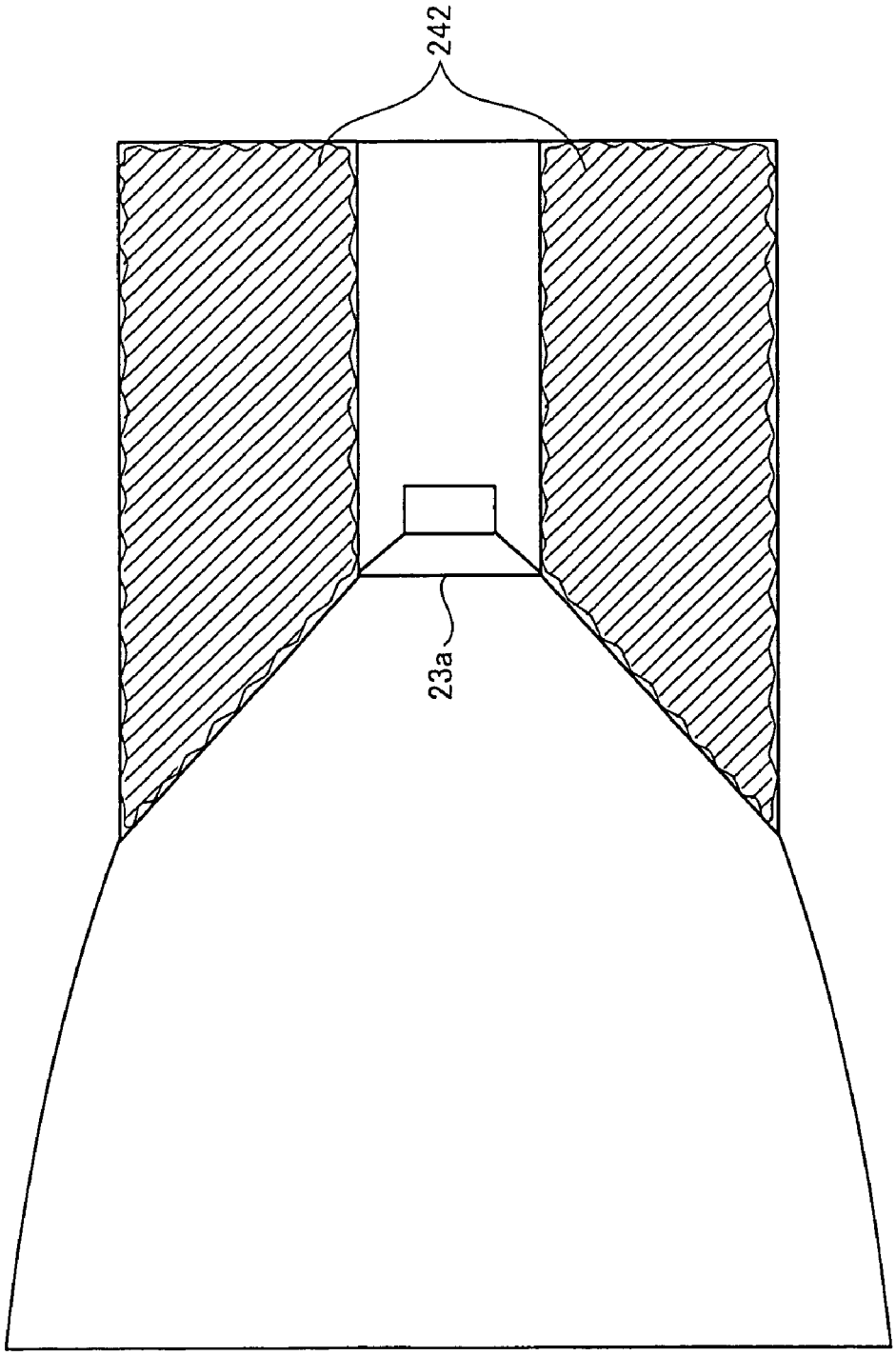
FIG. 20 is a diagram showing another aspect of the embodiment of the speaker apparatus of the present invention, the aspect relating to the form of glass wool that is a sound absorbing material.

FIGS. 19 and 20 are diagrams showing other aspects of the embodiment of the speaker apparatus of the present invention, the aspects relating to the form of glass wool that is a sound absorbing material.

According to the embodiment of the speaker apparatus of the present invention, the sound absorbing material need not necessarily be placed behind the vibrating surface as shown in the second to ninth embodiment, provided that it is placed so as to surround the vibrating surface. As shown by shading in FIG. 19, the sound absorbing material 241 may extend to a position in front of the vibrating surface 23*a*. Alternatively, as shown by shading in FIG. 20, in order to form a path through which a sound from the vibrating surface 23*a* is emitted, it is possible to provide a sound absorber 242 shaped to surround the emission path. Further, the surface area and volume of the sound absorber 242 may be increased to allow the more effective absorption and attenuation of, for example, a reflected sound which may occur inside the hood and which may reduce the directivity.

Figure 21:
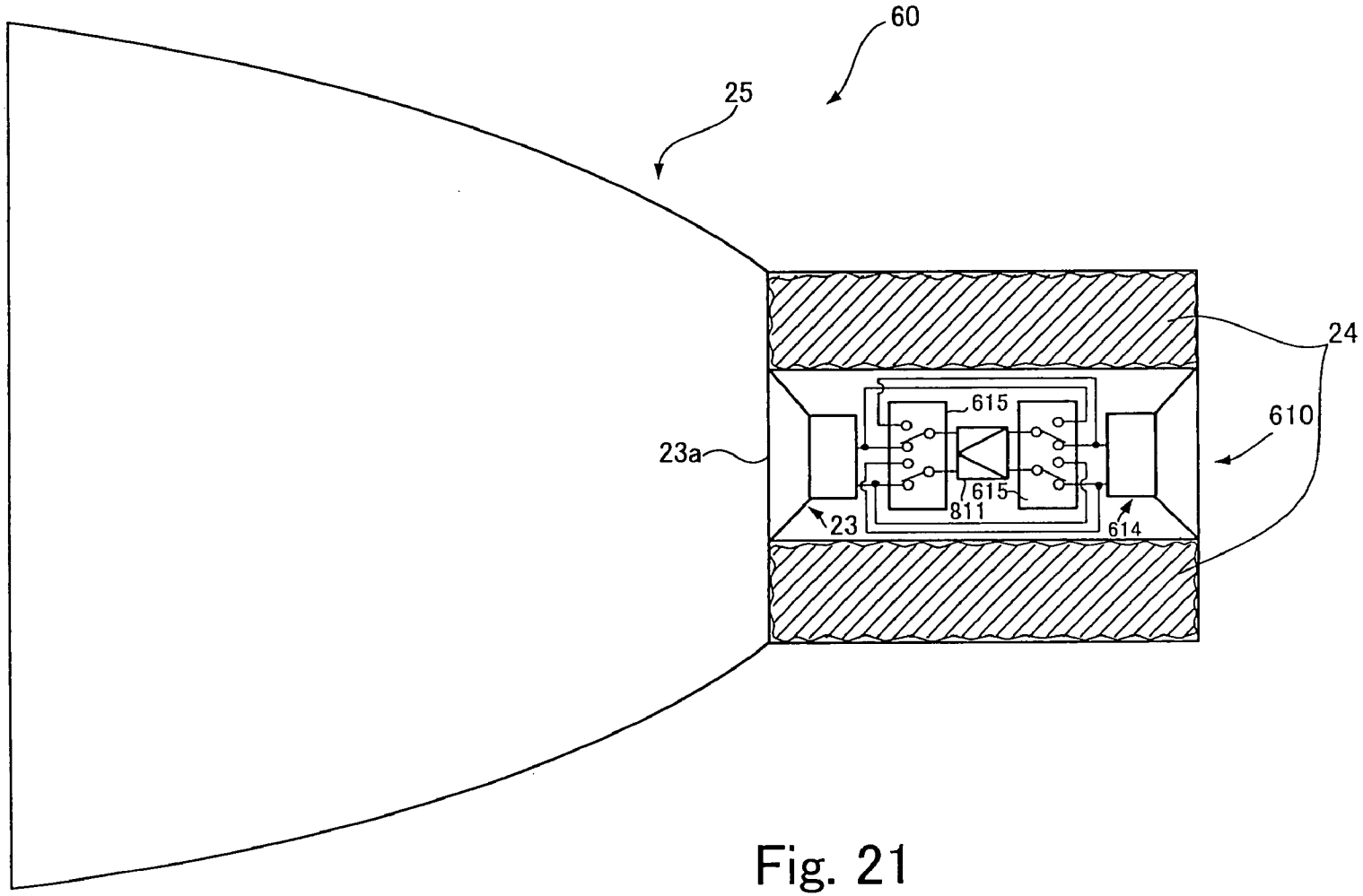
FIG. 21 is a schematic sectional view of another aspect of the sixth embodiment shown in FIG. 15.

FIG. 21 is a schematic sectional view of another aspect of the sixth embodiment shown in FIG. 15.

A sound processing section 610 of a speaker 60 shown in FIG. 21 is mainly composed of two electroacoustic transducers 23 and 614 each having a vibrating surface, the amplifier 811 that amplifies a signal, and the switch 615 that switches the transmission and reception of a signal between the amplifier 811 and each of the two electroacoustic transducers 23 and 614. In FIG. 21, the switch 615 is operated to emit sound to the exterior of the hood.

In the above description of the embodiments, an example of the sound absorbing material is the glass wool. However, the present invention is not limited to this. Any sound absorbing material may be used provided that it has a sound absorbing function. Alternatively, a sound absorbing material may be installed in an area which is close to the rear surface of the case and in which the vibrating surface and microphone are not present.

Further, in the above description of the embodiments, by way of example, the vibrating surface 23*a* and the circuit and the like which carry out, for example, the transmission of signals to the vibrating surface 23*a* are housed in the hood. However, the circuit and the like may be provided outside the hood using an electric cable or the like, with only the vibrating surface 23*a* left in the hood.

Furthermore, in the above description of the embodiments, byway of example, the vibrating surface is a plane. However, in another preferred aspect, the vibrating surface is spherical as shown in FIG. 22.

Figure 22:
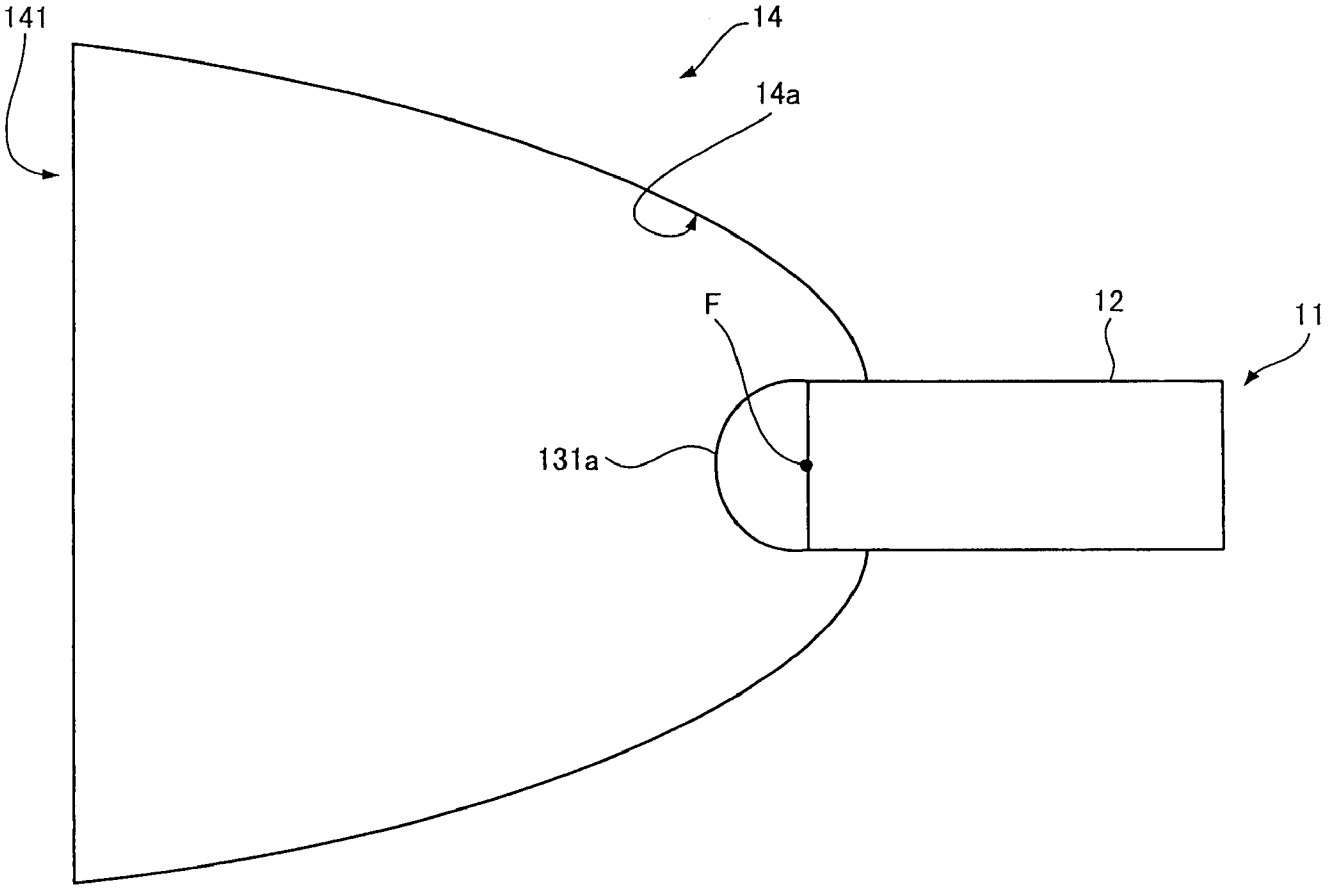
FIG. 22 is a schematic sectional view corresponding to FIG. 2 for the first embodiment.

FIG. 22 is a schematic sectional view corresponding to FIG. 2 of the first embodiment.

FIG. 22 shows another aspect of the first embodiment in which the vibrating surface 13*a*, which is a plane in FIG. 2, is changed to a spherical vibrating surface 131*a* that projects toward the opening 141 in the hood 14. The vibrating surface 131*a* is driven by driving section such as an amplifier connected to electrodes (not shown) formed on the inner and outer surfaces of the spherical surface. In this aspect, by matching the focus F of the hood with the center of curvature of the spherical vibrating surface 131*a*, it is possible to improve the directivity of sound emissions from the spherical vibrating surface 131*a*.

Further, in the third embodiment of the speaker apparatus of the present invention, the glass wool 31 is placed along the periphery of the opening of the hood to absorb and attenuate a diffracted wave traveling from the periphery of the opening of the hood toward the rear surface. However, it is contemplated that the speaker may be installed as shown below so as not to allow the diffracted wave to travel from the periphery of the opening of the hood toward the rear surface.

Figure 23:
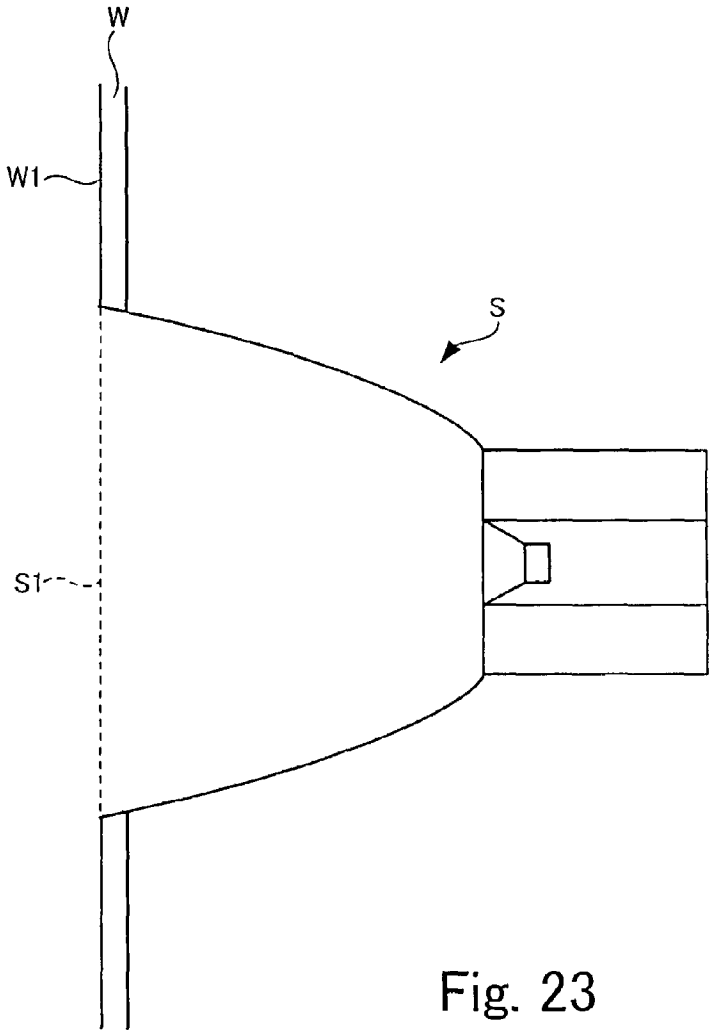
FIG. 23 is a diagram showing that the speaker is installed by being buried in a wall.

FIG. 23 is a diagram showing that the speaker is installed by being buried in a wall.

In FIG. 23, the speaker shown in FIG. 8 is free from the glass wool 31, placed in the periphery of the hood. Further, the speaker described above, which has a high directivity and which can emit sound, that is, any (hereinafter referred to as the speaker S) of the speakers of the first to ninth embodiments, is buried in a wall W so that an opening surface S1 and a wall surface W1 are flush with each other. This prevents the diffracted wave from traveling from the periphery of the opening of the hood toward the rear surface.

Figure 24:
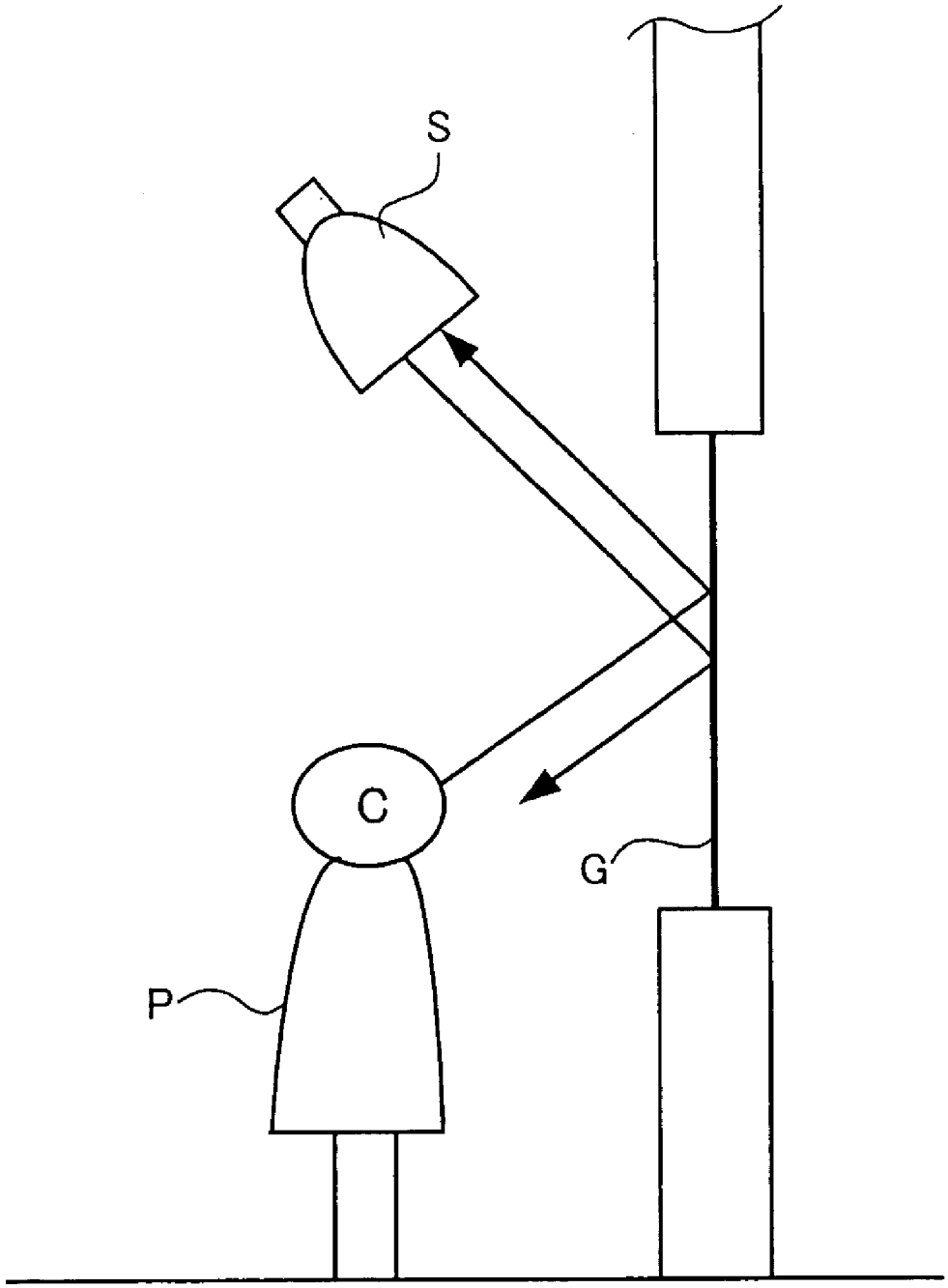
FIG. 24 is a diagram showing an example of installation of the speaker.
Figure 25:
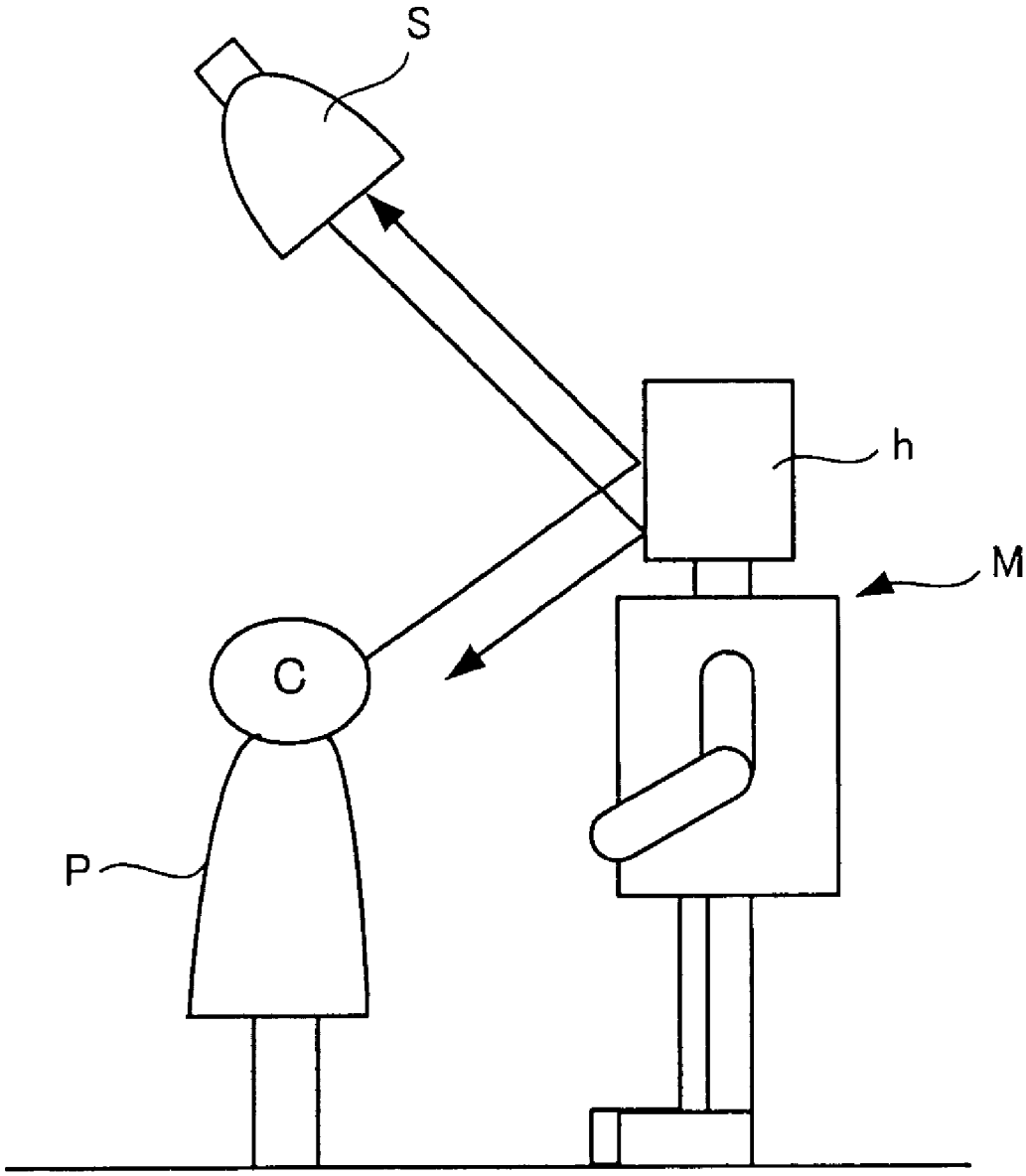
FIG. 25 is a diagram showing an example of installation of the speaker.
Figure 26:
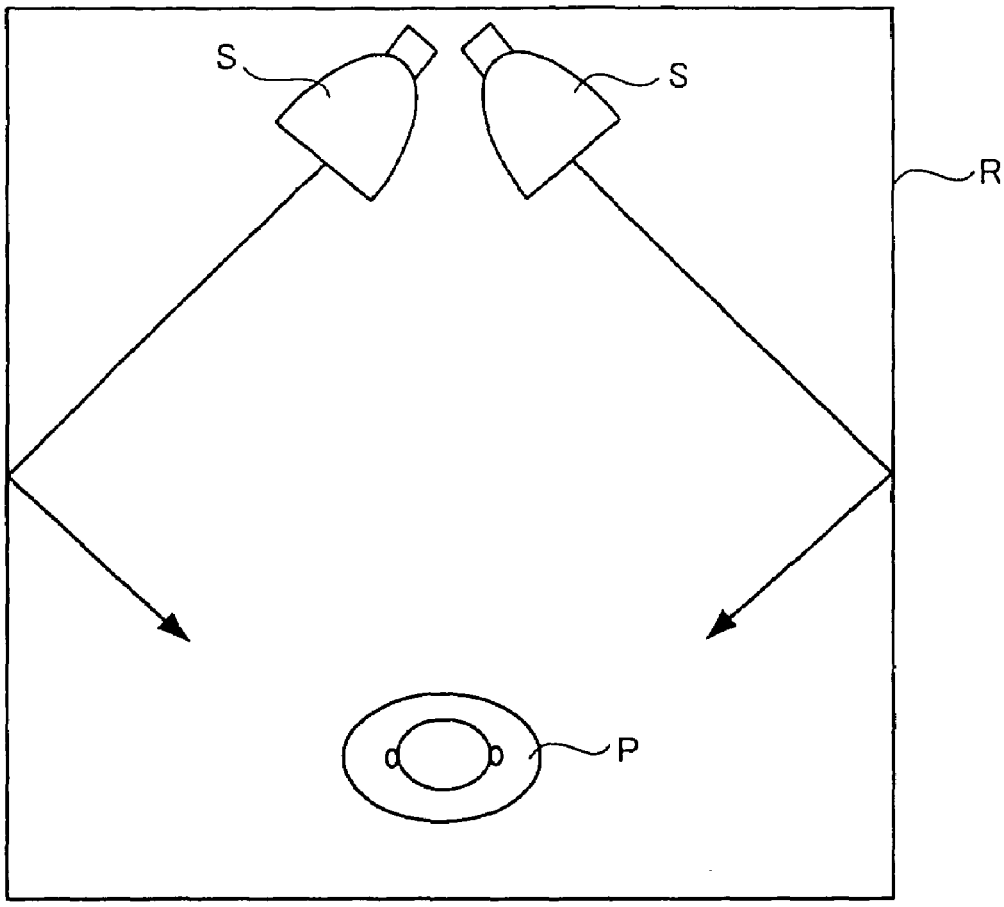
FIG. 26 is a diagram showing an example of installation of the speaker.

FIGS. 24 to 26 are diagrams showing examples of installation of the speakers.

In FIG. 24, the speaker S installed above a person P emits sound to a reflector G such as glass which is set in a reception window so that the person P can hear the sound reflected. The person P thus feels that the sound comes from the reflector G (for example, the surface of the glass). Further, for example, in a hospital, it is possible to reduce the possibility that a receptionist is secondarily infected with viruses through a direct conversation with a person infected with the viruses, without making the latter person feel alienated. The conversation with the reception desk can be collected through a microphone provided in the speaker to protect privacy. Furthermore, in an art museum, sound is emitted to a case of exhibits so that only a person standing in front of the exhibits can hear the sound. This contributes to reducing noise in the art medium.

FIG. 25 shows that the speaker S is installed so as to emit sound to a head h of a robot M that is an exhibit. This enables the person P to feel that the person P is actually talking with the robot M.

FIG. 26 shows a room R as viewed from above. Two speakers S are installed at the top of the room R. The two speakers can form a stereo sound field at a predetermined position in the room R (in this case, the person P is standing at the predetermined position).

The invention claimed is:

1. A speaker apparatus comprising:

a hood having an opening at a front end with a sound reflecting inner wall shaped like a rotating surface and provided at least on the opening side, the sound reflecting inner wall having a focus behind the opening, the hood being formed with an internal space;

a sound processing section at a rear end of the hood having a vibrating surface and a sound emitting circuit that vibrates the vibrating surface; and a sound absorbing material placed at the rear end of the hood so as to surround the sound processing section and abut a periphery of the vibrating surface, wherein at least the vibrating surface of the sound processing section is placed at the focus and so as to face a front surface of the hood.

2. The speaker apparatus according to claim 1, further comprising a sound emission profile adjusting mechanism that adjusts the spread, outside the hood, of a sound emitted from the vibrating surface, by adjusting a longitudinal position of the sound processing section in the hood.

3. The speaker apparatus according to claim 1, wherein the sound processing section further comprising a sound emitting circuit and a sound receiving circuit that detects vibration of the vibrating surface caused by an externally incident sound.

4. The speaker apparatus according to claim 1, wherein the sound processing section comprises a microphone having a sound receiving surface near the vibrating surface.

5. The speaker apparatus according to claim 1, further comprising a light beam emitting section that emits a light beam parallel to a rotation axis of the sound reflecting inner wall shaped like a rotating surface in the hood.

6. The speaker apparatus according to claim 1, further comprising a front illuminating light source in the hood.

7. The speaker apparatus according to claim 1, further comprising a sound absorbing material placed along an outer surface of the hood proximate the opening.

8. The speaker apparatus according to claim 1, wherein the vibrating surface is a spherical surface that projects forward.

9. The speaker apparatus according to claim 1, wherein the sound absorbing material is placed so as to extend around the periphery of the vibrating surface and backward from the vibrating surface.

10. The speaker apparatus according to claim 1, wherein the sound absorbing material is placed so as to extend around the periphery of the vibrating surface and to a position in front of the vibrating surface.

11. The speaker apparatus according to claim 1, wherein concaves and convexes are formed on at least one of a front surface of the sound absorbing material and a surface of the sound absorbing material which contacts with an inner wall of the hood, and the concaves and convexes thus irregularly reflect sound.

12. The speaker apparatus according to claim 1, further comprising a partition wall placed in front of the vibrating surface to isolate at least a rear area of the internal space from the outside of the hood, the area including the vibrating surface.

13. A speaker apparatus comprising:

a hood having an opening at a front end with a sound reflecting inner wall and provided at least on the opening side, the sound reflecting inner wall having a focus behind the opening, the hood being formed with an internal space;

a sound processing section having a vibrating surface and a sound emitting circuit that vibrates the vibrating surface; and a sound absorbing material placed along an outer surface of the hood proximate the opening, wherein the vibrating surface of the sound processing section is placed at the focus.

* * * * *